US007362319B2

(12) United States Patent
Neal

(10) Patent No.: US 7,362,319 B2
(45) Date of Patent: Apr. 22, 2008

(54) METHOD AND APPARATUS FOR AUTO-GENERATION OF HORIZONTAL SYNCHRONIZATION OF AN ANALOG SIGNAL TO A DIGITAL DISPLAY

(75) Inventor: Greg Neal, San Jose, CA (US)

(73) Assignee: Genesis Microchip Inc., Santa Clara, CA (US)

( * ) Notice: Subject to any disclaimer, the term of this patent is extended or adjusted under 35 U.S.C. 154(b) by 548 days.

(21) Appl. No.: 11/011,399

(22) Filed: Dec. 13, 2004

(65) Prior Publication Data

US 2005/0093855 A1 May 5, 2005

Related U.S. Application Data

(62) Division of application No. 10/243,518, filed on Sep. 12, 2002, now Pat. No. 7,019,764.

(60) Provisional application No. 60/323,968, filed on Sep. 20, 2001.

(51) Int. Cl.
*G09G 5/00* (2006.01)

(52) U.S. Cl. ..... 345/204; 345/211; 345/213; 345/619; 345/660

(58) Field of Classification Search ..... 345/213, 345/204, 589, 211, 619, 698, 660, 3.1, 99, 345/3.3, 536; 348/584, 14.12, 510, 500, 348/272, 461; 358/534; 386/49; 455/556.2; 341/143; 709/217; 381/66
See application file for complete search history.

(56) References Cited

U.S. PATENT DOCUMENTS

| | | | | |
|---|---|---|---|---|
| 4,158,200 | A * | 6/1979 | Seitz et al. | 345/589 |
| 4,196,451 | A * | 4/1980 | Pellar | 358/534 |
| 5,161,033 | A * | 11/1992 | Kuroda | 386/49 |
| 5,592,165 | A * | 1/1997 | Jackson et al. | 341/143 |
| 5,717,469 | A | 2/1998 | Jennes et al. | |
| 5,731,843 | A | 3/1998 | Cappels | |
| 5,751,338 | A * | 5/1998 | Ludwig, Jr. | 348/14.12 |
| 5,805,233 | A | 9/1998 | West | |
| 5,841,430 | A * | 11/1998 | Kurikko | 345/213 |
| 5,874,937 | A | 2/1999 | Kesatoshi | |
| 6,005,557 | A | 12/1999 | Wong | |
| 6,097,437 | A | 8/2000 | Hwang | |

(Continued)

FOREIGN PATENT DOCUMENTS

| | | |
|---|---|---|
| JP | 10091127 | 4/1998 |

(Continued)

*Primary Examiner*—Prabodh Dharia
(74) *Attorney, Agent, or Firm*—Beyer Weaver LLP

(57) ABSTRACT

Determining a horizontal resolution and a phase of an analog video signal arranged to display a number of scan lines each formed of a number of pixels is described. A number of initialization values are set where at least one of the initialization values is a current horizontal resolution and then a difference value for each immediately adjacent ones of the pixels is determined. Next, an edge flag value based upon the difference value is stored in at least one of a number of accumulators such that when at least one of the accumulators has a stored edge flag value that is substantially greater than those stored edge flag values in the other accumulators, then the horizontal resolution is set to the current resolution.

22 Claims, 20 Drawing Sheets

U.S. PATENT DOCUMENTS

| | | | | |
|---|---|---|---|---|
| 6,097,444 | A | 8/2000 | Nakano | |
| 6,122,010 | A * | 9/2000 | Emelko | 348/461 |
| 6,268,848 | B1 | 7/2001 | Eglit | |
| 6,297,794 | B1 * | 10/2001 | Tsubouchi et al. | 345/204 |
| 6,313,822 | B1 * | 11/2001 | McKay et al. | 345/698 |
| 6,340,993 | B1 | 1/2002 | Hasegawa et al. | |
| 6,452,592 | B2 | 9/2002 | Zhang et al. | |
| 6,473,131 | B1 | 10/2002 | Neugebauer et al. | |
| 6,501,310 | B2 | 12/2002 | Takami | |
| 6,522,365 | B1 | 2/2003 | Levantovsky et al. | |
| 6,538,648 | B1 * | 3/2003 | Koike et al. | 345/213 |
| 6,556,191 | B1 * | 4/2003 | Ouchi | 345/204 |
| 6,559,837 | B1 | 5/2003 | Lasneski et al. | |
| 6,664,977 | B1 | 12/2003 | Masumoto | |
| 6,724,381 | B2 | 4/2004 | Sakashita | |
| 6,734,919 | B2 | 5/2004 | Champion et al. | |
| 6,750,855 | B1 | 6/2004 | Von Hase | |
| 6,753,926 | B1 | 6/2004 | Nishino | |
| 7,061,540 | B2 * | 6/2006 | Weaver et al. | 348/500 |
| 7,286,674 | B2 * | 10/2007 | Karjalainen et al. | 381/66 |
| 2001/0022523 | A1 | 9/2001 | Takami | |
| 2002/0080280 | A1 * | 6/2002 | Champion et al. | 348/584 |
| 2003/0052872 | A1 | 3/2003 | Neal | |
| 2003/0052898 | A1 | 3/2003 | Neal | |
| 2004/0189870 | A1 * | 9/2004 | Champion et al. | 348/510 |
| 2004/0196396 | A1 * | 10/2004 | Fujii et al. | 348/272 |
| 2006/0206582 | A1 * | 9/2006 | Finn | 709/217 |

FOREIGN PATENT DOCUMENTS

| | | |
|---|---|---|
| JP | 10153989 | 6/1998 |

* cited by examiner

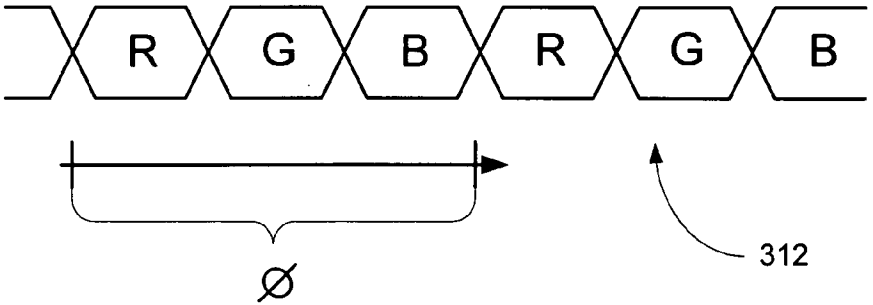
Fig. 4B
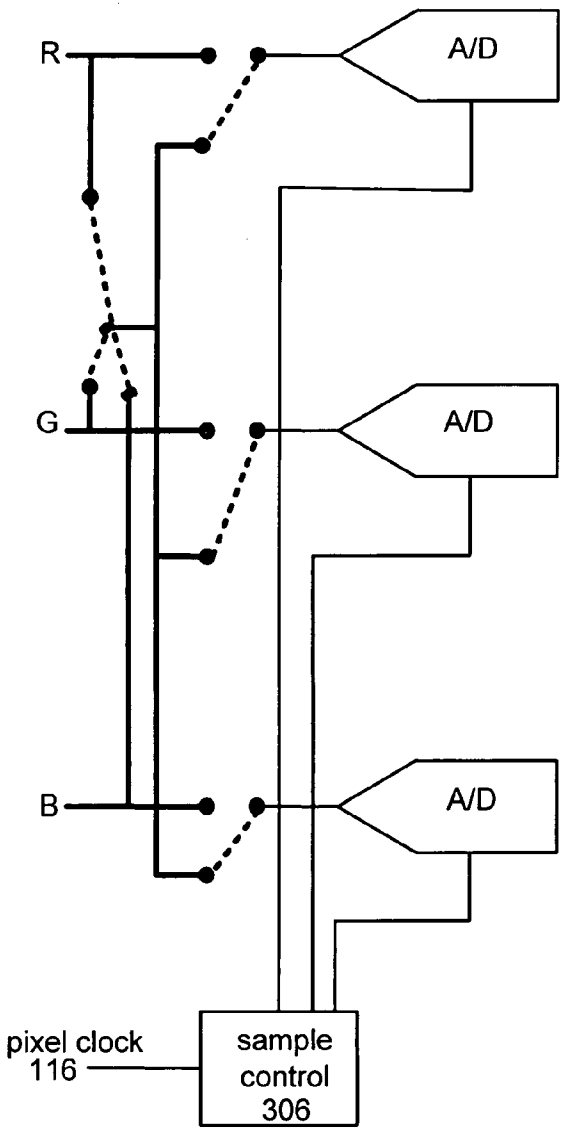

TABLE 6

| | |
|---|---|
| AUTO_CTRL | 0x2000 |
| Bit 7 | RUN/~STOP: Setting to a 1 starts measurement of 1 frame, starting with the next frame. When the frame is complete, this bit is cleared. |
| Bit 6 | PHASE_MODE: Setting to a 1 puts the circuitry in phase mode. |
| Bits 5-4 | DIFF0_CTRL: Controls the difference mode for ADC0:<br>00 – Absolute<br>01 – Positive<br>10 – Negative<br>11 - Raw |
| Bits 3-2 | DIFF1_CTRL: Controls the difference mode for ADC1 |
| Bits 1-0 | DIFF2_CTRL: Controls the difference mode for ADC2 |
| | |
| AUTO_X_START_L | 0x2001 - Window position registers (X values are doubled) |
| AUTO_X_START_M | 0c2002 |
| AUTO_X_END_L | 0x2003 |
| AUTO_X_END_M | 0x2004 |
| AUTO_Y_START_L | 0x2005 |
| AUTO_Y_START_M | 0x2006 |
| AUTO_Y_END_L | 0x2007 |
| AUTO_Y_END_M | 0x2008 |
| | |
| ADC0_THRESH | 0x2009 - Thresholds used for edge detection |
| ADC1_THRESH | 0x200a |
| ADC2_THRESH | 0x200b |
| | |
| LEVEL_THRESH | 0x200c |
| | Threshold used for detecting a non-black pixel |
| MIN_COUNT | 0x200d |
| | Data collection will stop when one of the edge accumulators reaches this value. |
| EDGE_COUNT_0 | 0x2010 |
| | Counts edges with phase 0/6 |
| EDGE_COUNT_1 | 0x2011 |
| | Counts edges with phase 1/6 |
| EDGE_COUNT_2 | 0x2012 |
| | Counts edges with phase 2/6 |
| EDGE_COUNT_3 | 0x2013 |
| | Counts edges with phase 3/6 |
| EDGE_COUNT_4 | 0x2014 |
| | Counts edges with phase 4/6 |
| EDGE_COUNT_5 | 0x2015 |
| | Counts edges with phase 5/6 |
| FLAT_ACCUM_L | 0x2016 |
| | Flatness accumulator lower 8 bits |

FIG. 16

METHOD AND APPARATUS FOR AUTO-GENERATION OF HORIZONTAL SYNCHRONIZATION OF AN ANALOG SIGNAL TO A DIGITAL DISPLAY

CROSS REFERENCE TO RELATED APPLICATIONS

This application is a divisional of U.S. patent application Ser. No. 10/243,518 entitled "METHOD AND APPARATUS FOR AUTO-GENERATION OF HORIZONTAL SYNCHRONIZATION OF AN ANALOG SIGNAL TO DIGITAL DISPLAY", filed on Sep. 12, 2002 now U.S. Pat. No. 7,019,764 that takes priority under 119(e) from U.S. Provisional Patent Application No. 60/323,968 entitled "METHOD AND APPARATUS FOR SYNCHRONIZING AN ANALOG VIDEO SIGNAL TO AN LCD MONITOR" filed Sep. 20, 2001 which are each incorporated by reference.

BACKGROUND OF THE INVENTION

1. Field of the Invention

The invention relates to liquid crystal displays (LCDs). More specifically, the invention describes a method and apparatus for automatically determining a horizontal resolution.

2. Description of the Related Art

Digital display devices generally include a display screen including a number of horizontal lines. The number of horizontal and vertical lines defines the resolution of the corresponding digital display device. Resolutions of typical screens available in the market place include 640×480, 1024×768 etc. At least for the desk-top and lap-top applications, there is a demand for increasingly bigger size display screens. Accordingly, the number of horizontal display lines and the number of pixels within each horizontal line has also been generally increasing.

In order to display a source image on a display screen, each source image is transmitted as a sequence of frames each of which includes a number of horizontal scan lines. Typically, a time reference signal is provided in order to divide the analog signal into horizontal scan lines and frames. In the VGA/SVGA environments, for example, the reference signals include a VSYNC signal and an HSYNC signal where the VSYNC signal indicates the beginning of a frame and the HSYNC signal indicates the beginning of a next source scan line. Therefore, in order to display a source image, the source image is divided into a number of points and each point is displayed on a pixel in such a way that point can be represented as a pixel data element. Display signals for each pixel on the display may be generated using the corresponding display data element.

However, in some cases, the source image may be received in the form of an analog signal. Thus, the analog data must be converted into pixel data for display on a digital display screen. In order to convert the source image received in analog signal form to pixel data suitable for display on a digital display device, each horizontal scan line must be converted to a number of pixel data. For such a conversion, each horizontal scan line of analog data is sampled a predetermined number of times ($H_{total}$) using a sampling clock signal (i.e., pixel clock). That is, the horizontal scan line is usually sampled during each cycle of the sampling clock. Accordingly, the sampling clock is designed to have a frequency such that the display portion of each horizontal scan line is sampled a desired number of times ($H_{total}$) that corresponds to the number of pixels on each horizontal display line of the display screen.

In general, a digital display unit needs to sample a received analog display signal to recover the pixel data elements from which the display signal was generated. For accurate recovery, the number of samples taken in each horizontal line needs to equal $H_{total}$. If the number of samples taken is not equal to $H_{total}$, the sampling may be inaccurate and resulting in any number and type of display artifacts (such as moire patterns).

Therefore what is desired is an efficient method and apparatus for automatically adjusting $H_{total}$ (clock) and phase for an incoming RGB signal suitable for display on a fixed position pixel display such as an LCD in such a way that the $H_{total}$ and phase adjustments are made with a very high degree of accuracy very quickly on almost any incoming signal.

SUMMARY OF THE INVENTION

According to the present invention, methods, apparatus, and systems are disclosed for determining a horizontal resolution of an analog video signal suitable for display on a fixed position pixel display such as an LCD.

In one embodiment, a method of determining a horizontal resolution of an analog video signal arranged to display a number of scan lines each formed of a number of pixels is described. A number of initialization values are set where at least one of the initialization values is a current horizontal resolution and then a difference value for each immediately adjacent ones of the pixels is determined. Next, an edge flag value based upon the difference value is stored in at least one of a number of accumulators such that when at least one of the accumulators has a stored edge flag value that is substantially greater than those stored edge flag values in the other accumulators, then the horizontal resolution is set to the current resolution. Otherwise, the current resolution is updated and control is passed back to the generating.

In another embodiment, an apparatus for determining a true horizontal resolution of an analog video signal is described.

In yet another embodiment of the invention, an analog video signal synthesizer unit is described that includes A selectable analog video signal synthesizer unit coupled to an analog video source arranged to provide an analog video signal operable in a number of operating modes that includes a normal mode, an $H_{total}$ mode, and a phase mode. The synthesizer unit includes a selectable set of analog switches operable in a number of switching modes coupled to the video source, a number of analog/digital converter units (ADC) each of which is connected to a corresponding one of the set of analog switches, a difference circuit arranged to receive an output signal from the ADCs and provide a differenced output signal based upon the operating mode, and an output unit coupled to the difference circuit arranged to provide an $H_{total}$ value in the $H_{total}$ mode and a phase value in the phase mode for the analog video signal.

In still another embodiment of the invention, a method of determining a phase of an analog video signal arranged to display a number of scan lines each formed of a number of pixels is described. A flat region of the video signal is determined and a central portion of the flat region is then determined where the phase is set based upon the flat region.

BRIEF DESCRIPTION OF THE DRAWINGS

The invention will be better understood by reference to the following description taken in conjunction with the accompanying drawings.

FIG. 4B shows an over sampling mode ADC in a particular embodiment of the invention.

FIG. 16 shows various registers used in a micro-controller based system.

DETAILED DESCRIPTION OF SELECTED EMBODIMENTS

Reference will now be made in detail to a particular embodiment of the invention an example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

Figure 1:
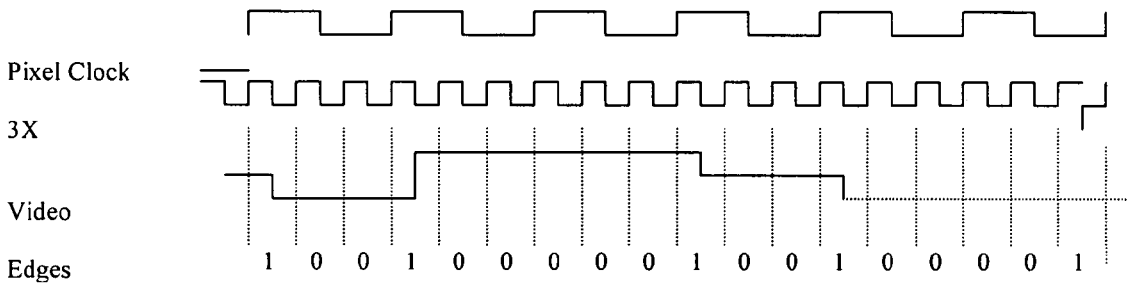
FIG. 1 shows an oversampled video signal and associated edges in accordance with an embodiment of the invention.

The basic concept behind the $H_{total}$ auto adjust is that all significant changes in the level of the video signal are caused by the pixel clock in the video generator of the video source. Consequently all changes of video level (displayed featured edges) will have the same phase relationship to the original pixel clock. Therefore, by regenerating the original pixel clock, the original horizontal resolution $H_{total}$ is determined. For example, in a described embodiment, when the video signal is oversampled by a pre-selected factor (i.e., 3×), then all of the displayed feature edges should fall in the same oversample as shown in FIG. 1 where only every third oversample has an edge.

In one embodiment, a method for determining a horizontal resolution ($H_{total}$) is described. In a video frame, a number of feature edges are found. A phase relationship of at least one of the number of feature edges is compared to a pixel clock and based upon the comparison, a horizontal resolution is provided.

The invention will now be described in terms of an analog video signal synchronizer unit (also referred to herein as an analog video signal synthesizer unit) capable of providing a horizontal resolution ($H_{total}$) and a pixel clock $P_{\Phi}$ and methods thereof capable of being incorporated in an integrated semiconductor device well known to those skilled in the art. It should be noted, however, that the described embodiments are for illustrative purposes only and should not be construed as limiting either the scope or intent of the invention.

Figure 2:
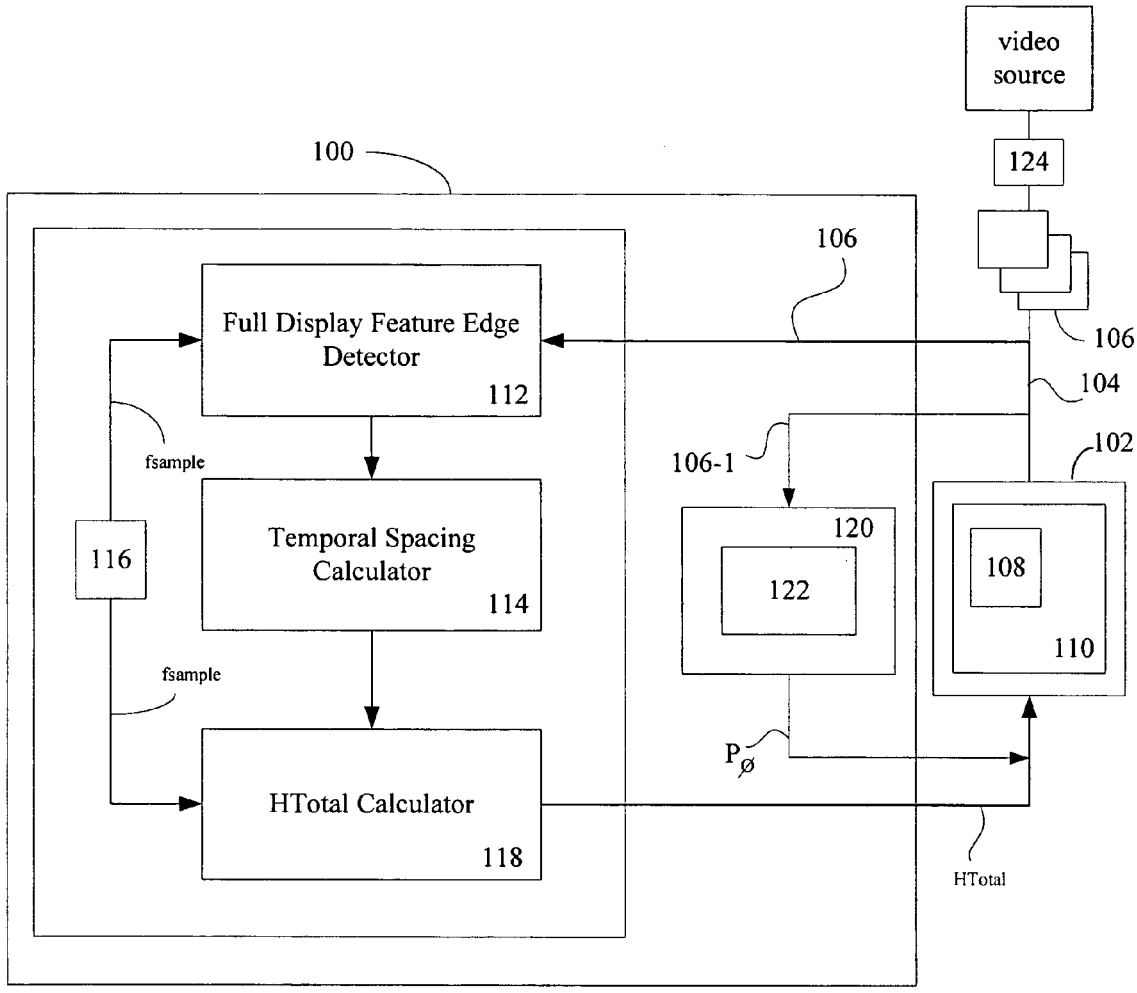
FIG. 2 shows an analog video signal synchronizer unit in accordance with an embodiment of the invention.

Accordingly, FIG. 2 shows an analog video signal synchronizer unit 100 in accordance with an embodiment of the invention. In the described embodiment, the analog video signal synchronizer unit 100 is coupled to an exemplary digital display 102 (which in this case is an LCD 102) capable of receiving and displaying an analog video signal 104 formed of a number of individual video frames 106 from analog video source (not shown). Typically, each video frame 106 includes video information displayed as a feature(s) 108 which, taken together, form a displayed image 110 on the display 102. It is these displayed features (and their associated edges) that are used to determine a horizontal resolution $H_{total}$ corresponding to the video signal 104 and the pixel clock $P_{\Phi}$.

It should be noted that the analog video signal synchronizer unit 100 can be implemented in any number of ways, such as a integrated circuit, a pre-processor, or as programming code suitable for execution by a processor such as a central processing unit (CPU) and the like. In the embodiment described, the video signal synchronizer unit 100 is typically part of an input system, circuit, or software suitable for pre-processing video signals derived from the analog video source such as for example, an analog video camera and the like, that can also include a digital visual interface (DVI).

In the described embodiment, the analog video signal synthesizer unit 100 includes a full display feature edge detector unit 112 arranged to provide information used to calculate the horizontal resolution value ($H_{total}$) corresponding to the video signal 104. By full display it is meant that almost all of the pixels that go to form a single frame of the displayed image 110 are used to evaluate the horizontal resolution value $H_{total}$. Accordingly, during a display monitor initialization procedure (or when a display resolution has been changed from, for example, VGA to XGA) that is either manually or automatically instigated, the feature edge detector unit 112 receives at least one frame 106 of the video signal 104. In a particular implementation, the feature edge detector unit 112 detects all positive rising edges (described below) of substantially all displayed features during the at least one frame 106 using almost all of the displayed pixels, or picture elements, used to from the displayed image 110. Once the feature edge detector unit 112 has detected a number of feature edges, a temporal spacing calculator unit 114 coupled to the feature edge detector unit 112 uses the detected feature edges to calculate an average temporal spacing value associated with the detected feature edges. Based upon a sample clock frequency $f_{sample}$ provided by a clock generator unit 116 and the average temporal spacing value, an $H_{total}$ calculator unit 118 calculates the horizontal resolution $H_{total}$.

Figure 3:
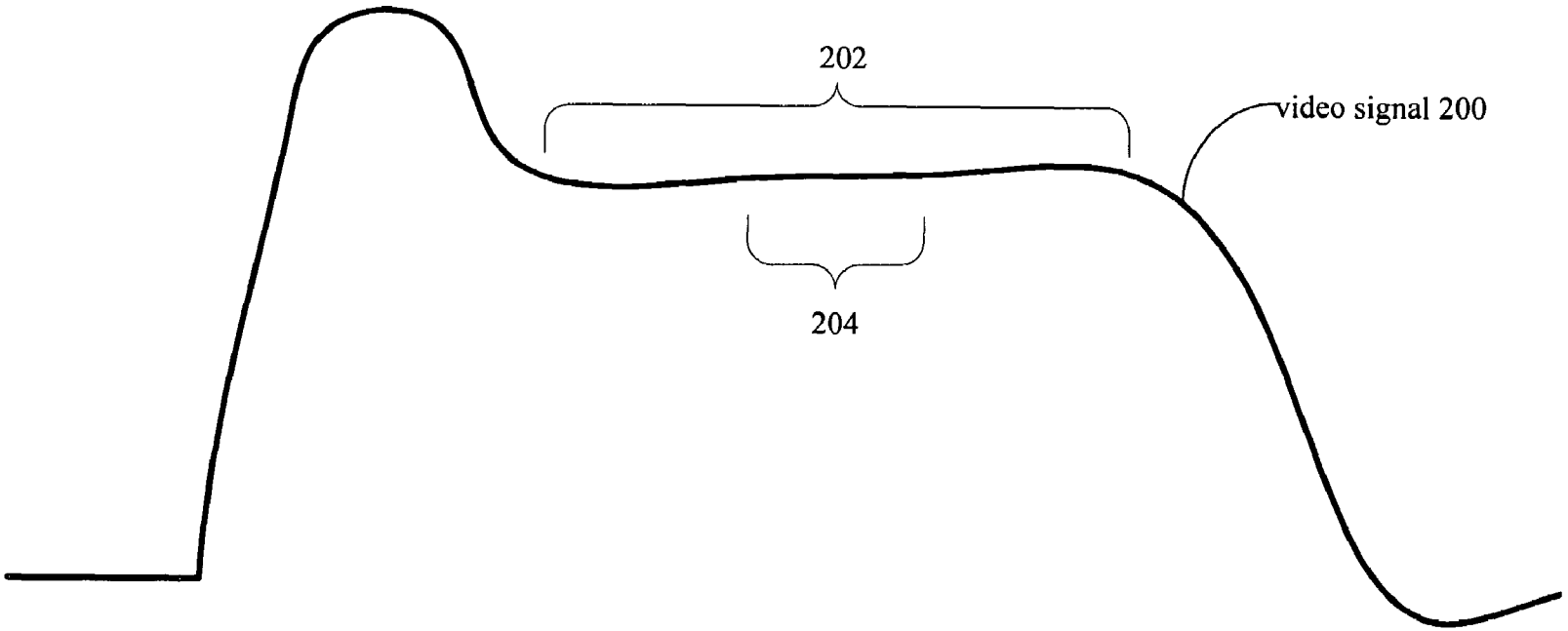
FIG. 3 shows a representative video signal.

In addition to calculating a best fit horizontal resolution $H_{total}$, the video signal synchronizer unit 100 also provides the pixel clock $P_{\phi}$ based upon the video signal 104 using a pixel clock estimator unit 120. The pixel clock estimator unit 120 estimates the pixel clock $P_{\phi}$ consistent with the video signal 104 using a flat region detector unit 122 that detects a flat region of the video signal 104 for a frame 106-1 (i.e., a different frame than is used to calculate the horizontal resolution $H_{total}$). For example, FIG. 3 shows a representative video signal 200 typically associated with a displayed feature having a flat region 202 characterized as that region of the signal 200 having a slope close to or equal to zero. Once the flat region has been established, the pixel clock $P_{\phi}$ is that pixel clock associated with a central portion 204 of the flat region 202.

In general, the video signal 104 is formed of three video channels (in an RGB based system, a Red channel (R), a Green channel (G), and a Blue channel (B)) such that when each is processed by a corresponding A/D converter, the resulting digital output is used to drive a respective sub-pixel (i.e., a (R) sub-pixel, a Green (G) sub-pixel, and a Blue (B) sub-pixel) all of which are used in combination to form a displayed pixel on the display 102 based upon a corresponding voltage level. For example, in those cases where each sub-pixel is capable of being driven by $2^8$ (i.e., 256) voltage levels a total of over 16 million colors can be displayed (representative of what is referred to as "true color"). For example, in the case of a liquid crystal display, or LCD, the B sub-pixel can be used to represent 256 levels of the color blue by varying the transparency of the liquid crystal which modulates the amount of light passing through the associated blue mask whereas the G sub-pixel can be used to represent 256 levels of the color green in substantially the same manner. It is for this reason that conventionally configured display monitors are structured in such a way that each display pixel is formed in fact of the 3 sub-pixels.

Referring back to FIG. 2, in the case where the video signal 104 is an analog video signal, an analog-to-digital converter (A/D) 124 is connected to the video image source. In the described embodiment, the A/D converter 124 converts an analog voltage or current signal into a digital video signal that can take the form of a waveform or as a discrete series of digitally encoded numbers forming in the process an appropriate pixel data word suitable for digital processing. It should be noted that any of a wide variety of A/D converters can be used. By way of example, various A/D converters include those manufactured by: Philips, Texas Instrument, Analog Devices, Brooktree, and others.

Figure 4A:
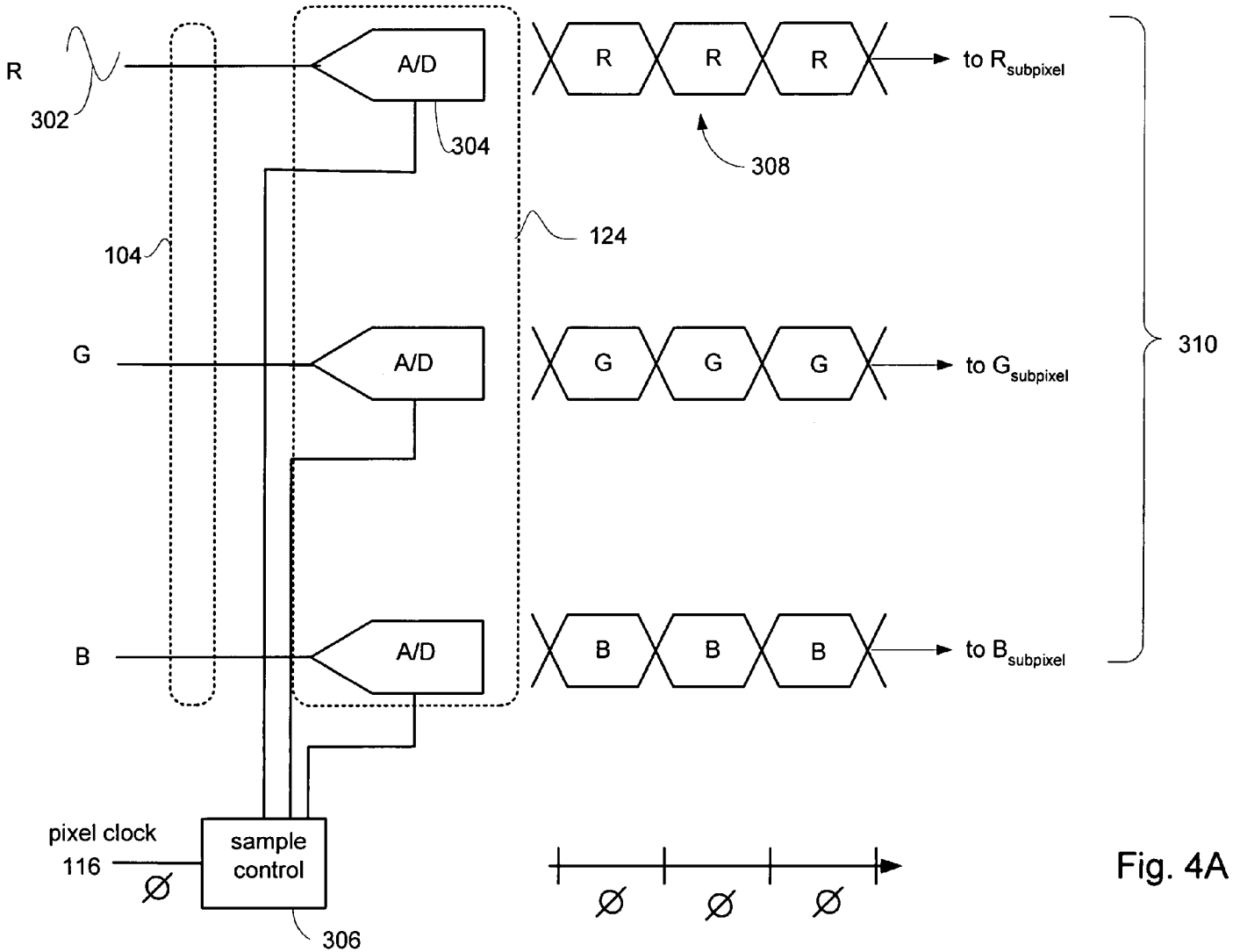
FIG. 4A illustrates the situation where each of the R, G, B channels has coupled thereto an associated A/D converter

Although an RGB based system is used in the subsequent discussion, the invention is well suited for any appropriate color space. FIG. 4A illustrates the situation where each of the R, G, B channels has coupled thereto an associated A/D converter (an arrangement well suited to preserve bandwidth) which taken together represent the A/D converter 124 shown in FIG. 2. Using the R video channel as an example, the R video channel passes an analog R video signal 302 to an associated R channel A/D converter 304. The R channel A/D converter 304, based upon a sample control signal provided by a sample control unit 306 coupled to the pixel clock generator 116, generates a digital R channel signal 308. This procedure is carried out for each of R, G, B video channels concurrently (i.e., during the same pixel clock cycle) such that for each pixel clock cycle, a digital RGB signal 310 is provided to each pixel of the display 102 (by way of its constituent sub-pixels).

By oversampling the incoming video signal, a resolution greater than one pixel (as is the case shown in FIG. 4A) is possible. Accordingly, in an over sampling mode provided in a particular embodiment of the invention as shown in FIG. 4B, each of the R, G, B, A/D converters are ganged together in such a way that all three video channels are combined to form a single 3×0 over sampled output signal 312. In this way, it is possible to resolve features and their associated feature edges to a resolution of ⅓ of a pixel (i.e., to the sub-pixel level) thereby greatly enhancing the ability to detect feature edges in a single frame, if necessary.

Figure 5:
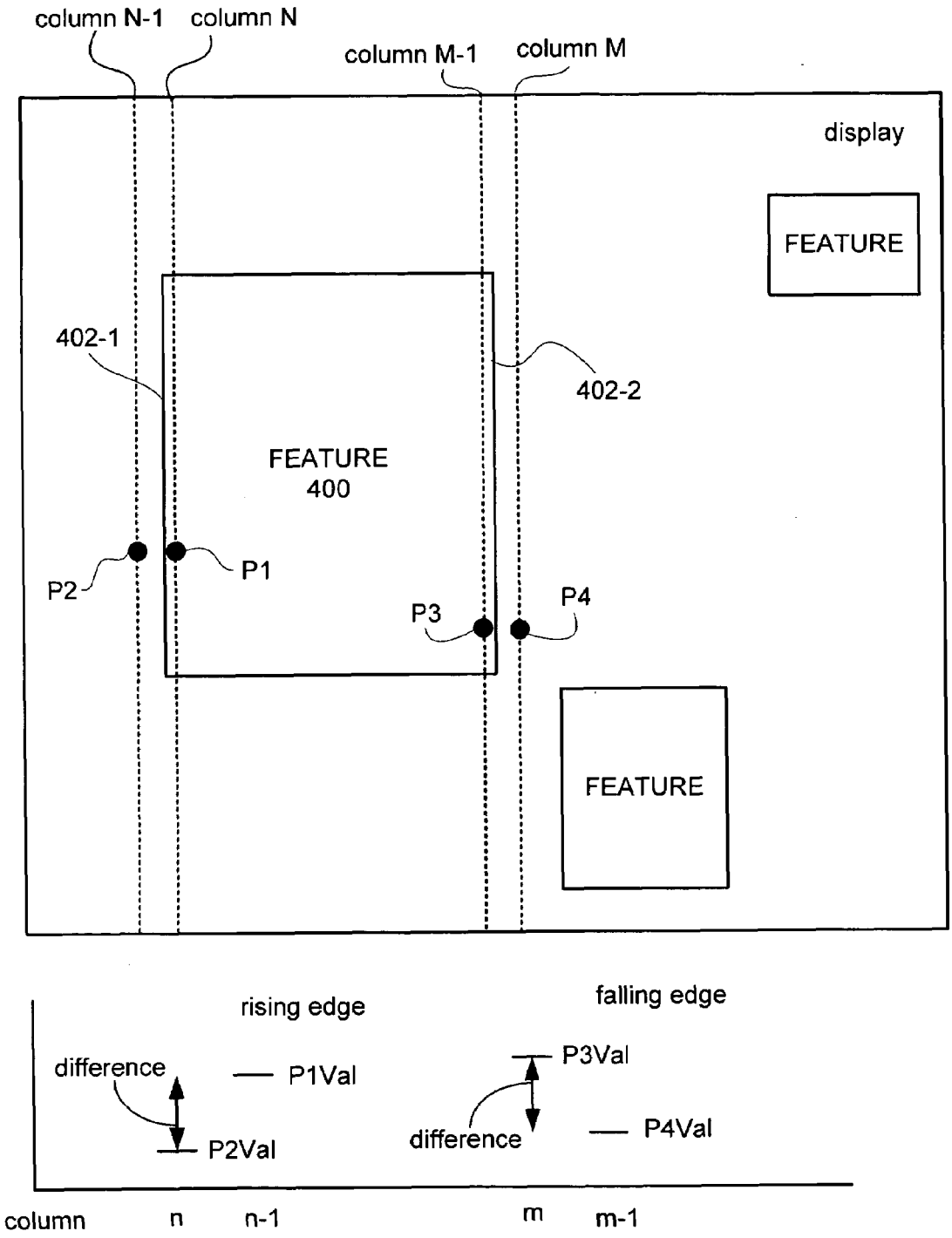
FIG. 5 that shows a feature having a number of feature edges.

Our attention is now directed to FIG. 5 that shows a feature 400 having a number of feature edges 402. A description of a particular approach to ascertaining if a feature edge is a rising feature edge based upon the characterization of a constituent pixel as a rising edge pixel is hereby presented. In the context of the invention, in order to characterize a feature edge 402-1 as a rising edge, a first pixel video signal value $P_{2val}$ associated with a first pixel $P_2$ in a column n-1 is determined and compared to a second pixel video signal value $P_{1val}$ associated with a second pixel a second pixel $P_1$ in an immediately adjacent column n. In the described embodiment, the compare operation is a difference operation according to equation 1:

$$\text{difference}=P_{1val}-P_{2val} \qquad \text{eq (1)}$$

If the difference value is positive, then the second pixel $P_1$ corresponds to what is referred to as a rising edge type pixel associated with a rising edge feature. Conversely, if the value of difference value is negative, then the second pixel $P_1$ corresponds to a falling edge pixel corresponding to a falling edge feature which is illustrated with respect to pixels $P_3$ and $P_4$ (where $P_3$ is the falling edge pixel). Using this approach, during at least a single video frame, every pixel in the display can be evaluated to whether it is associated with an edge and if so whether that edge is a rising edge or a falling edge. For example, typically an edge is characterized by a comparatively large difference value associated with two adjacent pixels since any two adjacent pixels that are in a blank region or within a feature will have a difference value of approximately zero. Therefore, any edge can be detected by cumulating most, if not all, of the difference values for a particular pair of adjacent columns. If the sum of differences for a particular column is a value greater than a predetermined threshold (for noise suppression purposes), then a conclusion can be drawn that a feature edge is located between the two adjacent columns.

Once a rising feature edge has been found, a determination of $H_{total}$ can be made since all features were created using the same pixel clock and consequently all edges should be synchronous to the pixel clock and the phase relationship between edges of clock and edges of video signal should be same. In other words, if substantially all of the feature edges have substantially the same phase relationship to a test pixel clock, then the test horizontal resolution is the true horizontal resolution, otherwise the test horizontal resolution is likely to be incorrect. Therefore, once all edges (or in some cases a minimum predetermined number of rising edges) in a frame have been located, then a determination is made whether or not the phase relationship between the edges of the pixel clock and the edges of the video signals corresponding to the feature edges are substantially the same. In one embodiment, an over sampled digital video signal corresponding to the displayed features is input to an arithmetic difference circuit which generates a measure of a difference between each successive over sampled pixel. In the case where the estimated $H_{total}$ is a true $H_{total}$ (i.e., corresponds to the pixel clock used to create the displayed features), then each the difference values for the feature edges should always appear in same time slot. By accumulating the difference values for adjacent pixels for an entire frame, a plot of difference values can be generated where each x coordinate of the plot corresponds to a displayed column having a value corresponding to a sum of the difference values for that column for adjacent over sampled pixels. In the case where a particular column contains a feature edge, then the difference results for only one time slot (of the three time slots in the case of 3× over sampling) should be a high (H) value indicating the presence of the feature edge whereas the other two time slots will contain a low (L) value.

Figure 6:
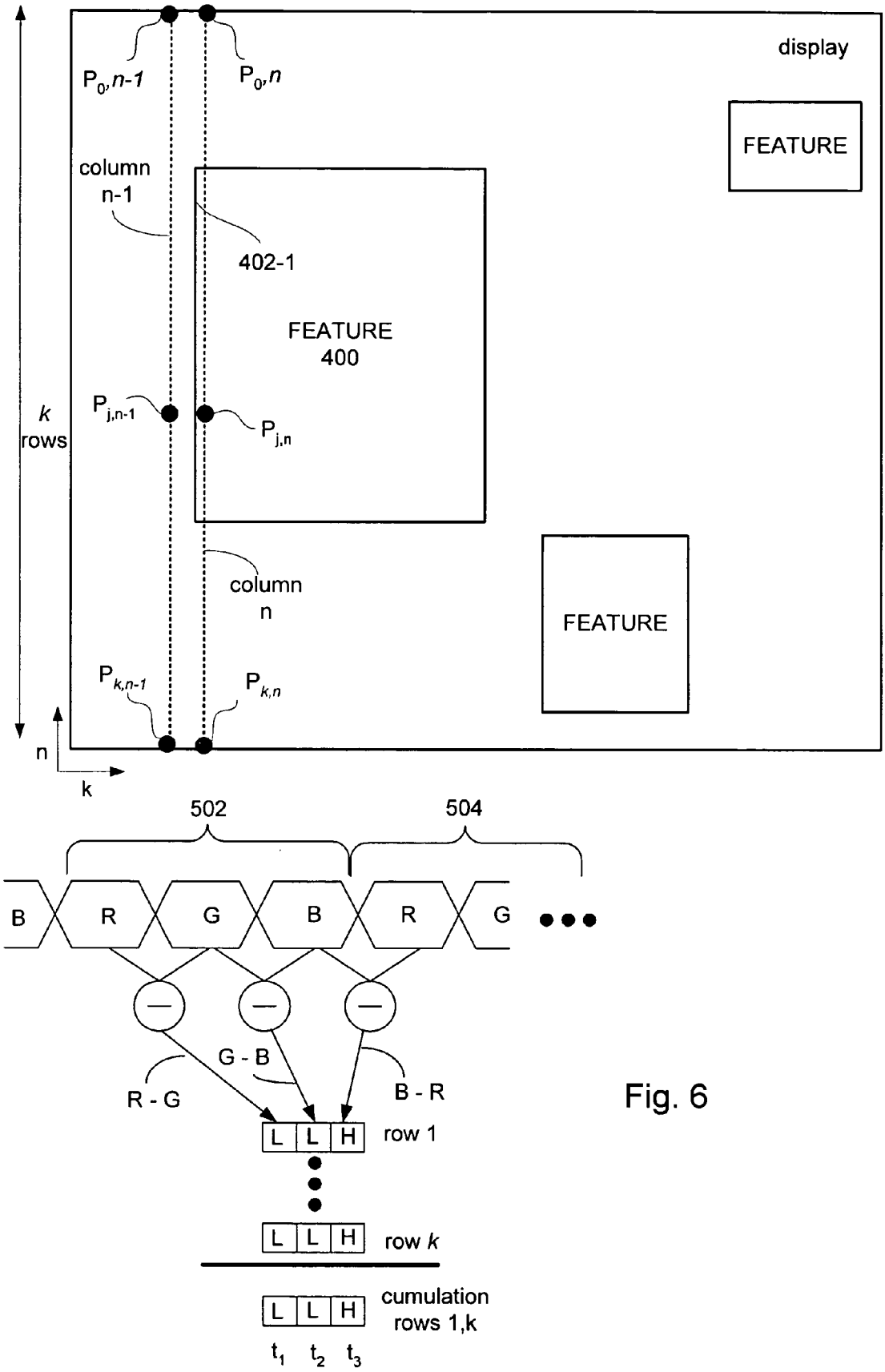
FIG. 6 shows the feature having the rising feature edge between adjacent columns.

For example, FIG. 6 shows the feature 400 having the rising feature edge 402-1 between adjacent column n-1 and column n where each column is formed of k pixels (one for each of the k rows). In the case of a 3× over sampled digital video signal 312, for each row k, a adjacent over sample pixel values are differenced (i.e., subtracted from one another as described above). For example, in the jth row (1<j<k) and n-1 column, pixel $Pj_{,n-1}$ has an associated over sampled pixel value 502 whereas an adjacent pixel $P_{j,n}$ has an associated over sampled pixel value 504. Differencing pixel values 502 and 504 results in a low (L) difference value in a first time slot $t_1$, a low (L) difference value in a second time slot $t_2$, and a high (H) difference value in a third time slot $t_3$. It should be noted that the high difference value is due to the fact that the high difference value represents the difference between the pixel $Pj_{,n-j}$ and the pixel $P_{j,n}$ which is part of the feature 402 is a rising edge type pixel.

Figure 7:
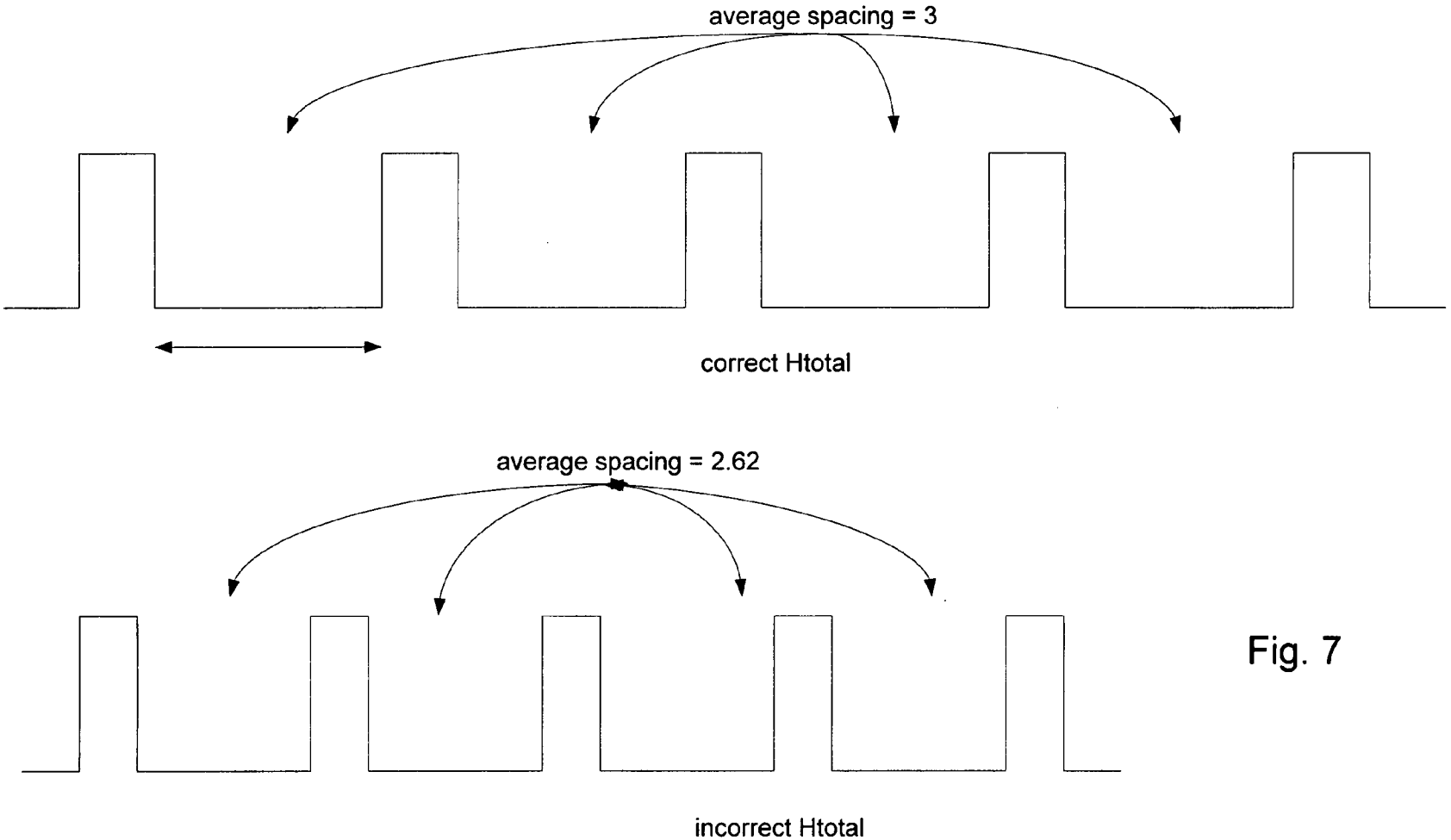
FIG. 7 illustrates representative temporal spacing patterns for true $H_{total}$ and not true $H_{total}$.

In this way, any feature edge 402-1 is characterized by a cumulated sum having a pattern of "L L H" having a temporal spacing of approximately 3.0 (corresponding to the spacing between each of the "H" values associated with each of the feature edges in the display). If, however, the estimated $H_{total}$ is not the true $H_{total}$, then the observed temporal spacing will not be 3.0. (Please refer to FIG. 7 showing just such a case where a test $H_{total}$ is not the true $H_{total}$ resulting in a temporal spacing that is not 3.0.) In this case, the true $H_{total}$ is related to the estimated $H_{total}$ based upon equation (2):

$$\{H_{total}(\text{test})/H_{total}(\text{true})\}=\{\text{average spacing}/3.0\} \quad \text{Eq. (2)}$$

Therefore, once the temporal spacing is calculated by the temporal spacing calculator 114, a true $H_{total}$ can be calculated by the $H_{total}$ calculator unit 118

In some embodiments, the total number of features are tallied and compared to a minimum number of features. In some embodiments, this minimum number can be as low as four or as high as 10 depending on the situation at hand. This is done in order to optimize the ability to ascertain $H_{total}$ since too few found features can provide inconsistent results.

Figure 8:
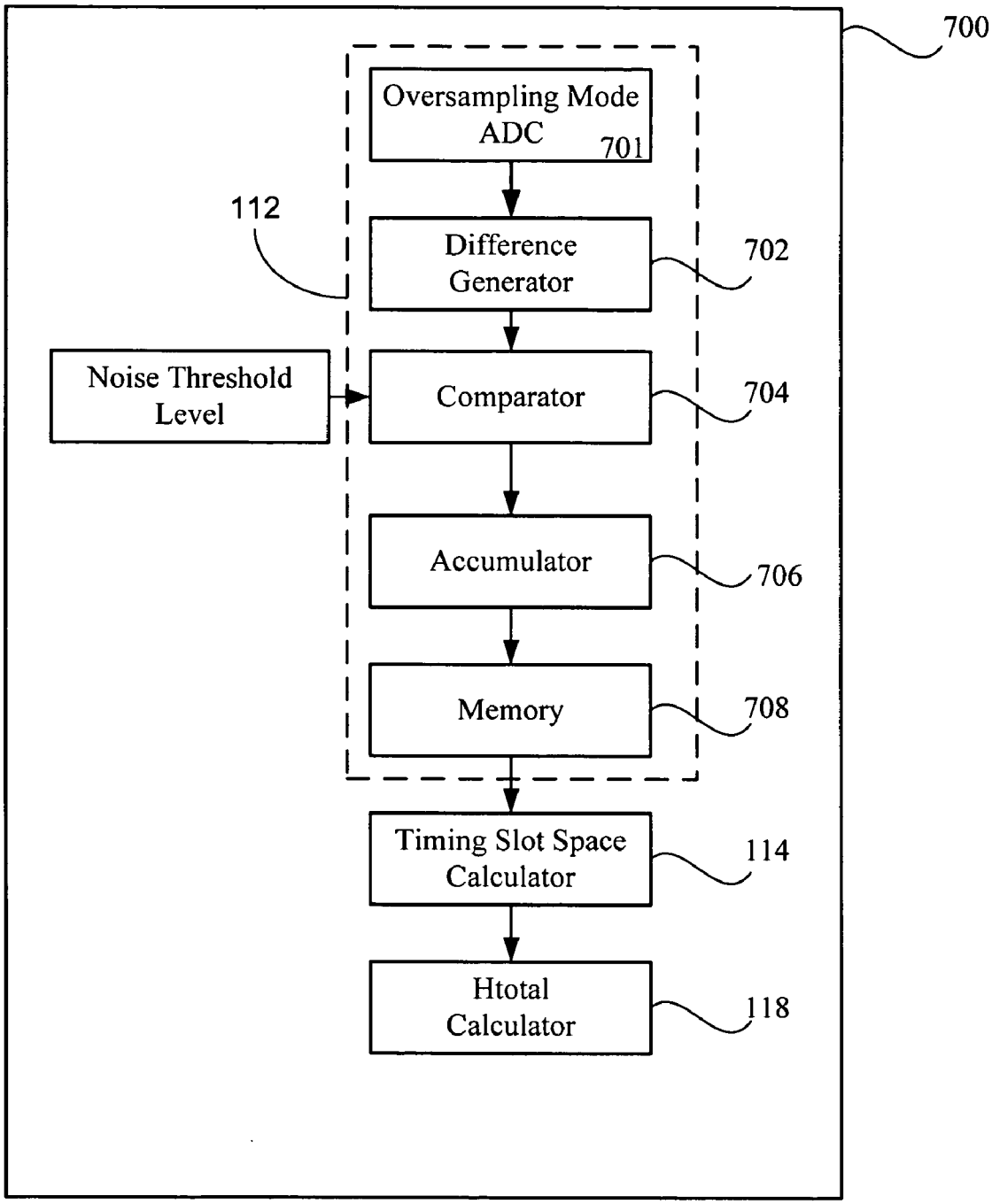
FIG. 8 illustrates a particular implementation of the full display feature edge detector shown in FIG. 1.

The following discussion describes a particular implementation 700 shown in FIG. 8 of the full display feature edge detector 112 in accordance with an embodiment of the invention. It should be noted, however, that the described operation is only one possible implementation and should therefore not be considered to be limiting either the scope or intent of the invention. Accordingly, the full display feature edge detector 112 includes an over sampling mode ADC 701 configured to produce a over sampled digital video signal. (It is contemplated that the ADC 701 can be a separate component fully dedicated to generating the over sampled digital signal or, more likely, is a selectable version of the ADC 124.)

The ADC 701 is, in turn, connected to a difference generator unit 702 arranged to receive the digital over sampled video signal from the ADC 701 and generate a set of difference result values. It should be noted that the ADC 124 is configured to provide the over sample digital video signal 312 for pre-selected period of time (usually a period of time equivalent to a single frame of video data). The difference generator unit 702 is, in turn, connected to a comparator unit 704 that compares the resulting difference result value to predetermined noise threshold level value(s) in order to eliminate erroneous results based upon spurious noise signals. In the described embodiment, the output of the comparator unit 704 is connected to an accumulator unit 706 that is used to accumulate the difference results for substantially all displayed pixels in a single frame which are subsequently stored in a memory device 708.

Once the difference result values for an entire frame have been captured and stored in the memory device 708, the time slot space calculator unit 114 coupled thereto queries the stored difference result values and determines a difference result values pattern. Once the difference results values pattern has been established, a determination of a best fit $H_{total}$ value is made by the $H_{total}$ calculator unit 118 based upon the observed time slot spacing of the difference results values pattern provided.

Figure 9:
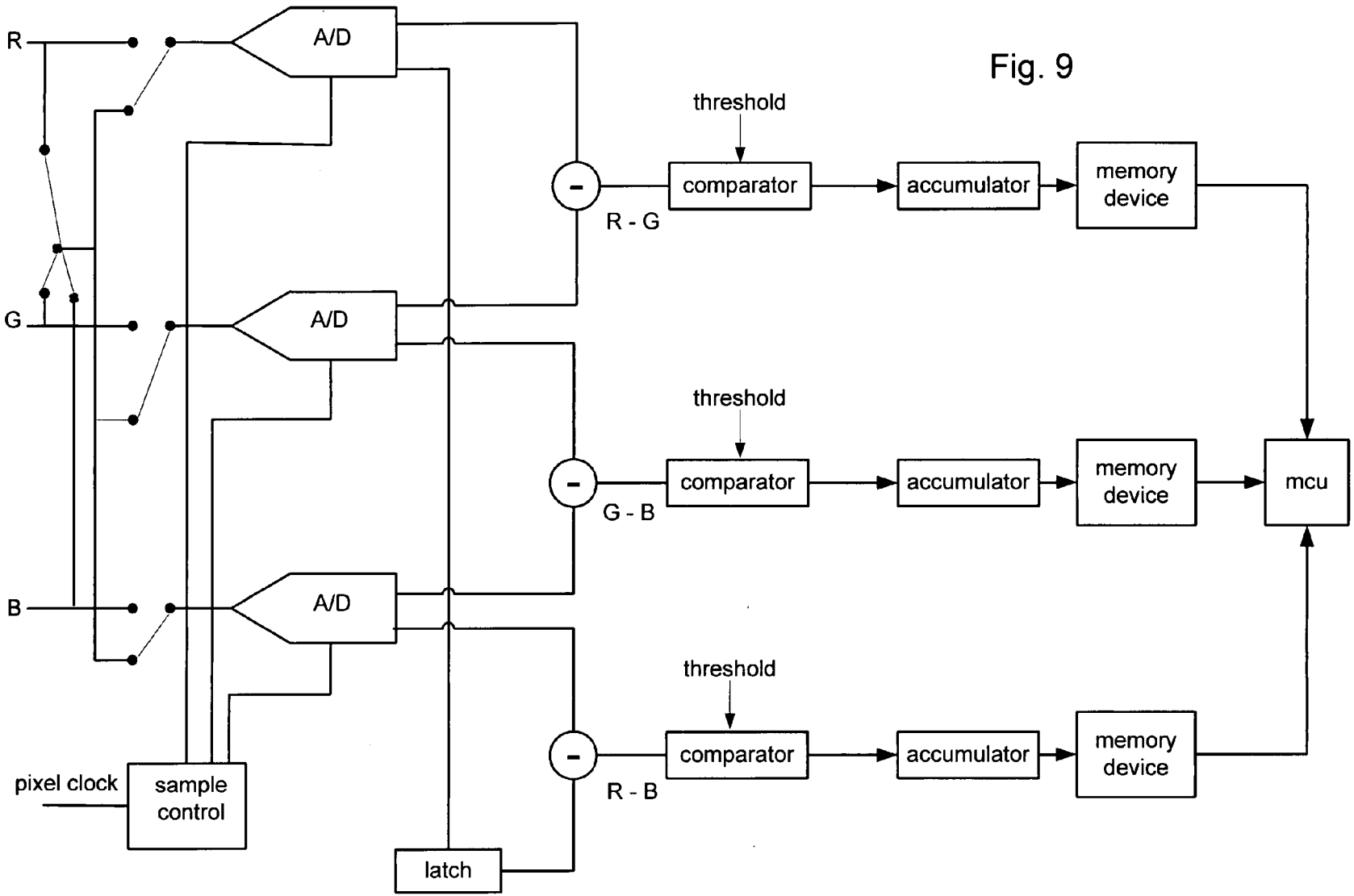
FIG. 9 illustrates yet another embodiment of the full display feature edge detector.

FIG. 9 illustrates yet another embodiment of the full display feature edge detector 112.

Figure 10:
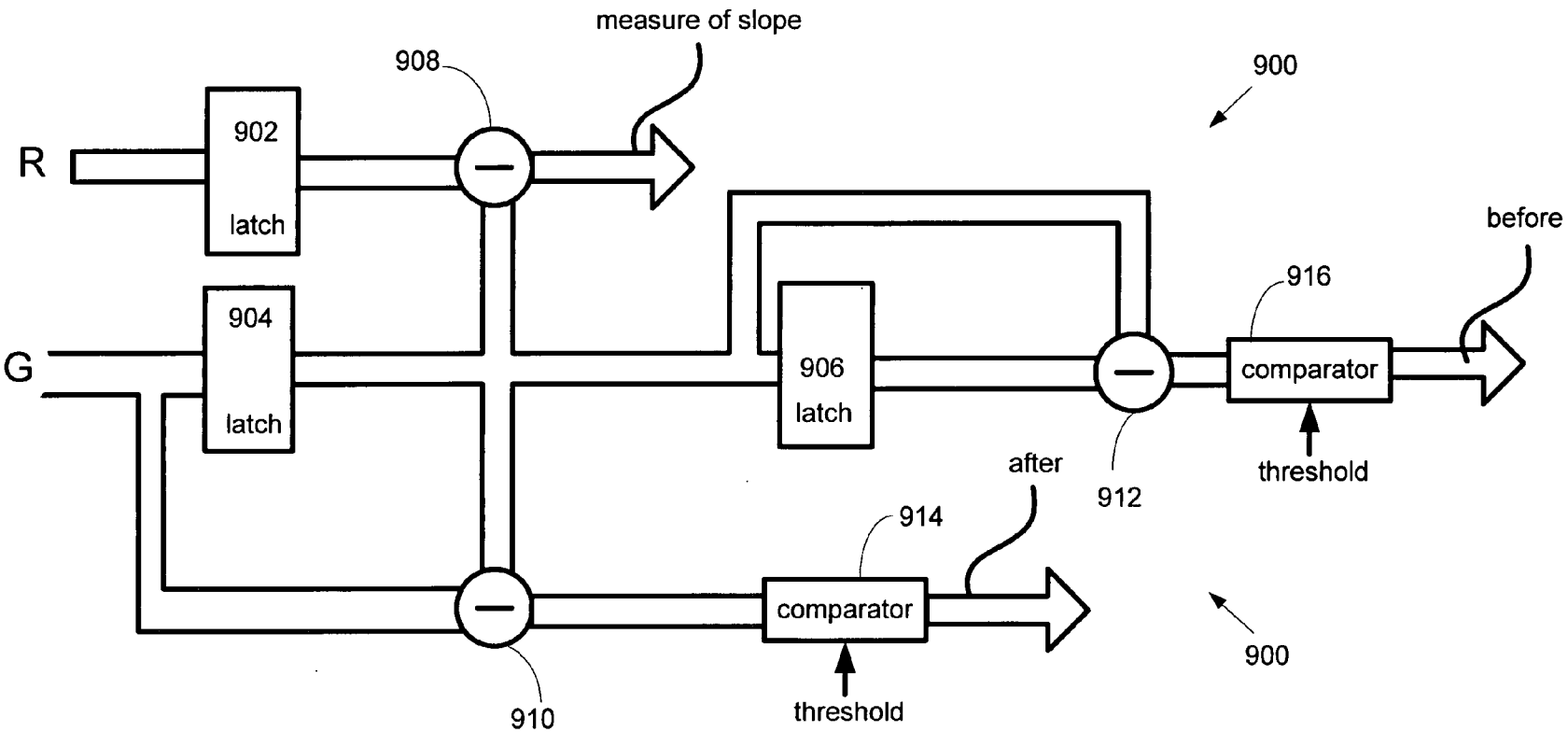
FIG. 10 illustrates a pixel clock estimator unit in accordance with an embodiment of the invention.

Subsequent to calculating a best fit horizontal resolution $H_{total}$, the video signal synchronizer unit 100 also provides pixel clock (phase) $P_{\Phi}$ based upon the video signal 104 using a pixel clock estimator unit 900 shown in FIG. 10. It should be noted that the pixel clock estimator unit 900 is a particular implementation of the pixel clock estimator unit 120 shown in FIG. 2 and therefore should not be construed as limiting either the scope or intent of the invention. It should also be noted that the pixel clock estimator unit 900 utilizes in the case of a three channel video signal (such as RGB) only two of the three channels to determining the best fit clock.

In the described embodiment, the pixel clock estimator unit 900 estimates the pixel clock $P_{\Phi}$ consistent with the video signal 104 using a flat region detector unit that detects a flat region of the video signal 104 for a frame 106-1 (i.e., a different frame than is used to calculate the horizontal resolution $H_{total}$). The flat region detector unit 122 provides a measure of a video signal slope using at least two of three input video signals that are latched by one pixel clock cycle.

Utilizing only the R and G video channels, for example, the flat region detector essentially monitors the same input channel (but off by one phase step or about 200 pS by the use of ADC sample control 306) such that any difference detected by a difference circuits coupled thereto is a measure of the slope at a particular phase of the video signal. The pixel clock estimator 900, therefore, validates only those slope values near an edge (i.e., both before and after) which are then accumulated as a before edge slope value, a before slope count value, an after edge slope value and an after edge count value. Once all the slopes have been determined, an average slope for each column is then calculated providing an estimate of the flat region of the video signal. In the described embodiment, the $H_{total}$ value is offset by a predetermined amount such that a particular number of phase points are evaluated for flatness. For example, if the $H_{total}$ is offset from the true $H_{total}$ by 1/64, the each real pixel rolls through 64 different phase points each of whose flatness can be determined and therefore used to evaluate the pixel clock $P_{\Phi}$.

With reference to FIG. 9, the R video channel and the G video channel are each coupled to a data latch circuit 902 and 904. In this way a previous R and G video signal are respectively stored and made available for comparison to a set of current R and G video signals. A difference circuit 908 provides a video signal slope value whereas a difference circuit 910 provides an after edge slope value and a difference circuit 912 provides a before edge slope value for substantially all pixels in the display. In a particular embodiment, comparator units 914 and 916 provide noise suppression by comparing the before edge and the after edge slope values with a predetermined threshold value thereby improving overall accuracy of the estimator unit 900.

Figure 11:
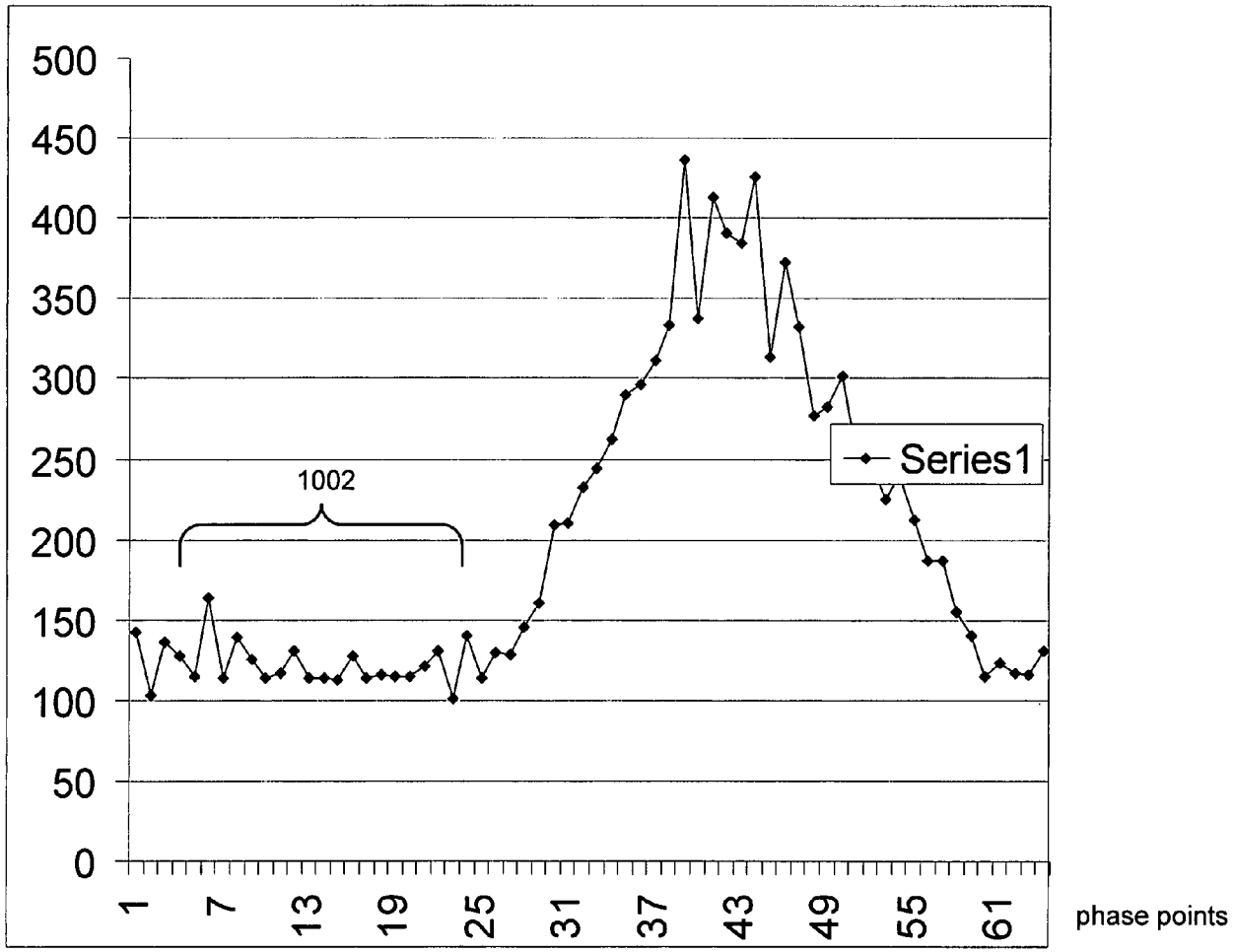
FIG. 11 is a graphical representation of a typical output response of the pixel clock estimator unit showing a flat region corresponding to a best pixel clock $P_{\Phi}$.

FIG. 11 is a graphical representation of a typical output response of the pixel clock estimator unit 900 showing a flat region 1002 corresponding to a best pixel clock $P_{\Phi}$.

Figure 12:
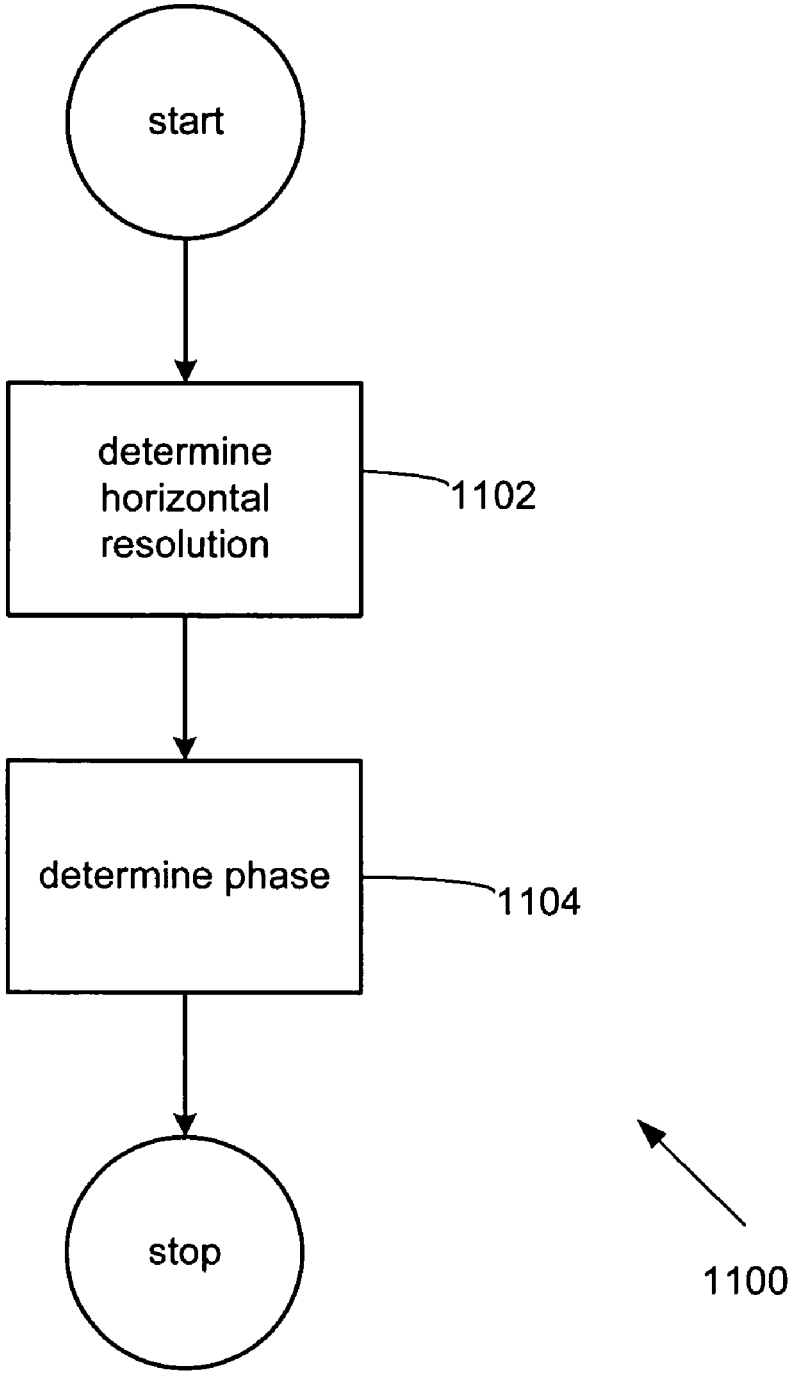
FIG. 12 details a process for synchronizing an analog video signal to an LCD monitor in accordance with an embodiment of the invention.
Figure 13:
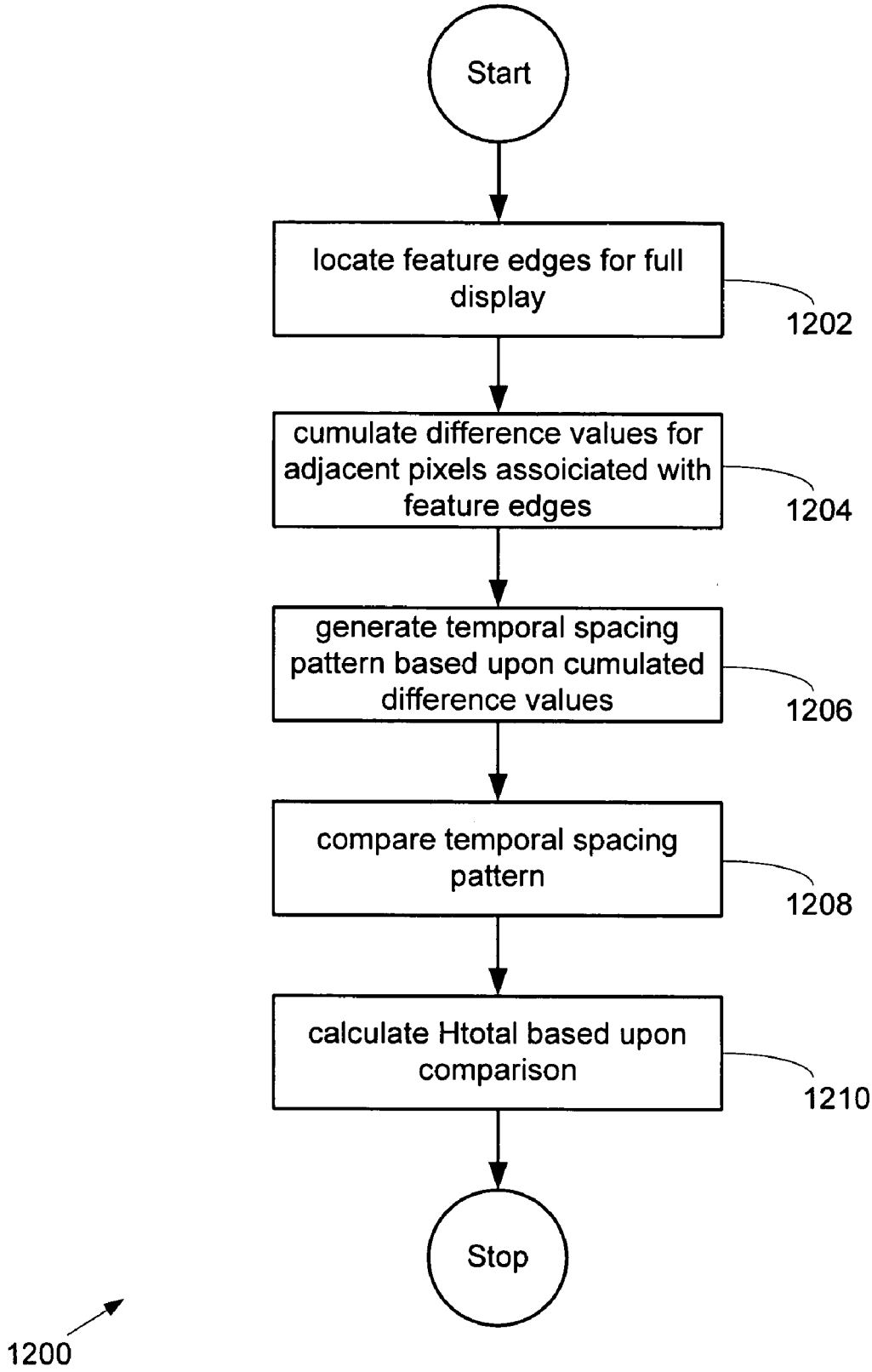
FIG. 13 illustrates a process for determining horizontal resolution in accordance with an embodiment of the invention.
Figure 14:
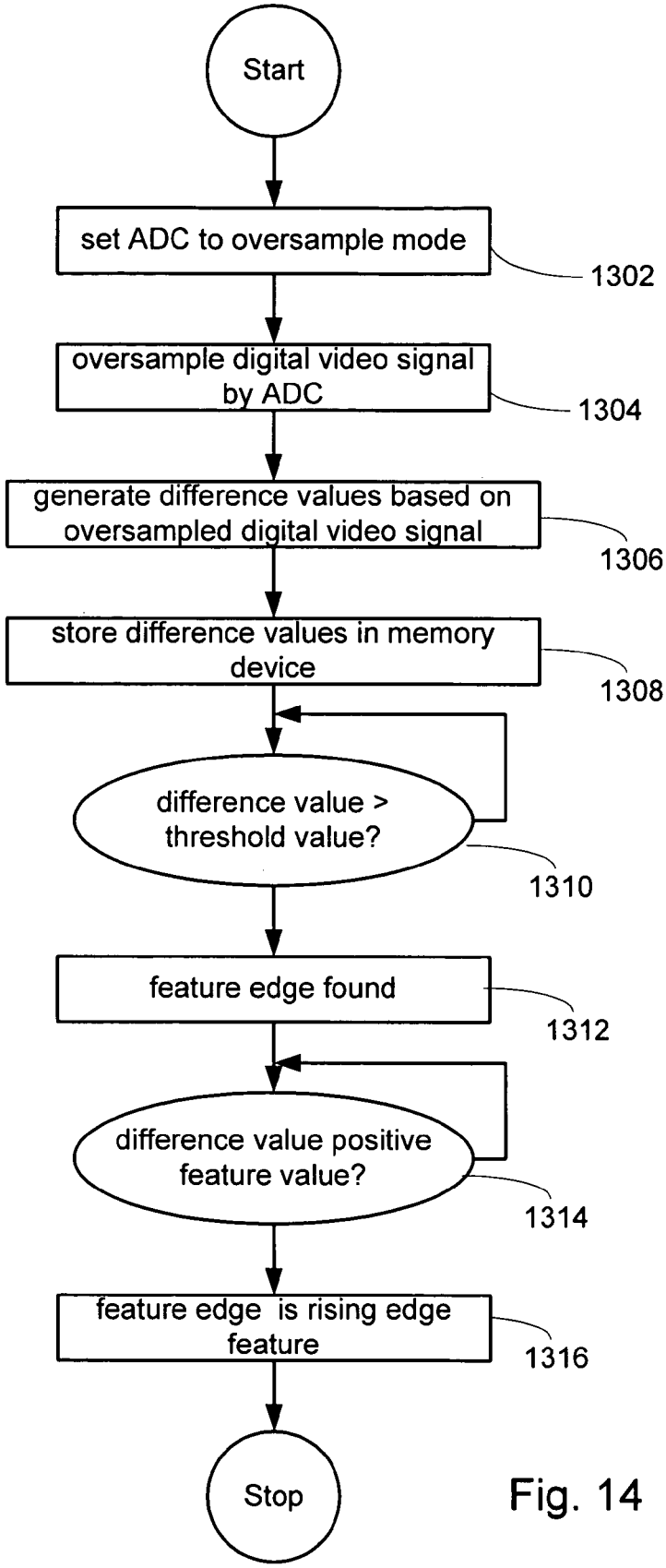
FIG. 14 shows a process for locating feature edges in a full display in accordance with an embodiment of the invention.

FIGS. 12-14 describe a process 1100 for synchronizing an analog video signal to an LCD monitor in accordance with an embodiment of the invention. As shown in FIG. 12, the process 1100 begins at 1102 by determining a horizontal resolution and at 1104 by determining a phase based in part upon the determined horizontal resolution. FIG. 13 illustrates a process 1200 for determining horizontal resolution in accordance with an embodiment of the invention. The process 1200 begins at 1202 by locating feature edges and at 1204 the difference values are cumulated in a column wise basis and based upon the cumulated difference values, a temporal spacing pattern is generated at 1206. The temporal spacing pattern is then compared at 1208 to a reference pattern associated with the true $H_{total}$ and at 1210 a best fit $H_{total}$ is calculated based upon the compare.

FIG. 14 shows a process 1300 for locating feature edges in a full display in accordance with an embodiment of the invention. The process 1300 begins at 1302 by setting an ADC to an over sample mode. It should be noted that in those situations where a dedicated oversampler is provided, then 1302 is optional. At 1304, a over sampled digital video is provided by the ADC while at 1306 a set of difference values based upon the over sampled digital video signal is generated. At 1308, the difference values are stored in memory while at 1310, the difference values are compared to a feature edge threshold value. If the difference value is greater than the feature edge threshold value, then the difference value is associated with an edge and a feature edge has been located at 1312. Once a feature edge has been located, a determination is made at 1314 if the found feature edge is a rising feature edge by determining if the difference value is positive indicating a rising feature edge. If the difference value is positive, then the feature edge is marked a rising feature edge at 1316.

Figure 15:
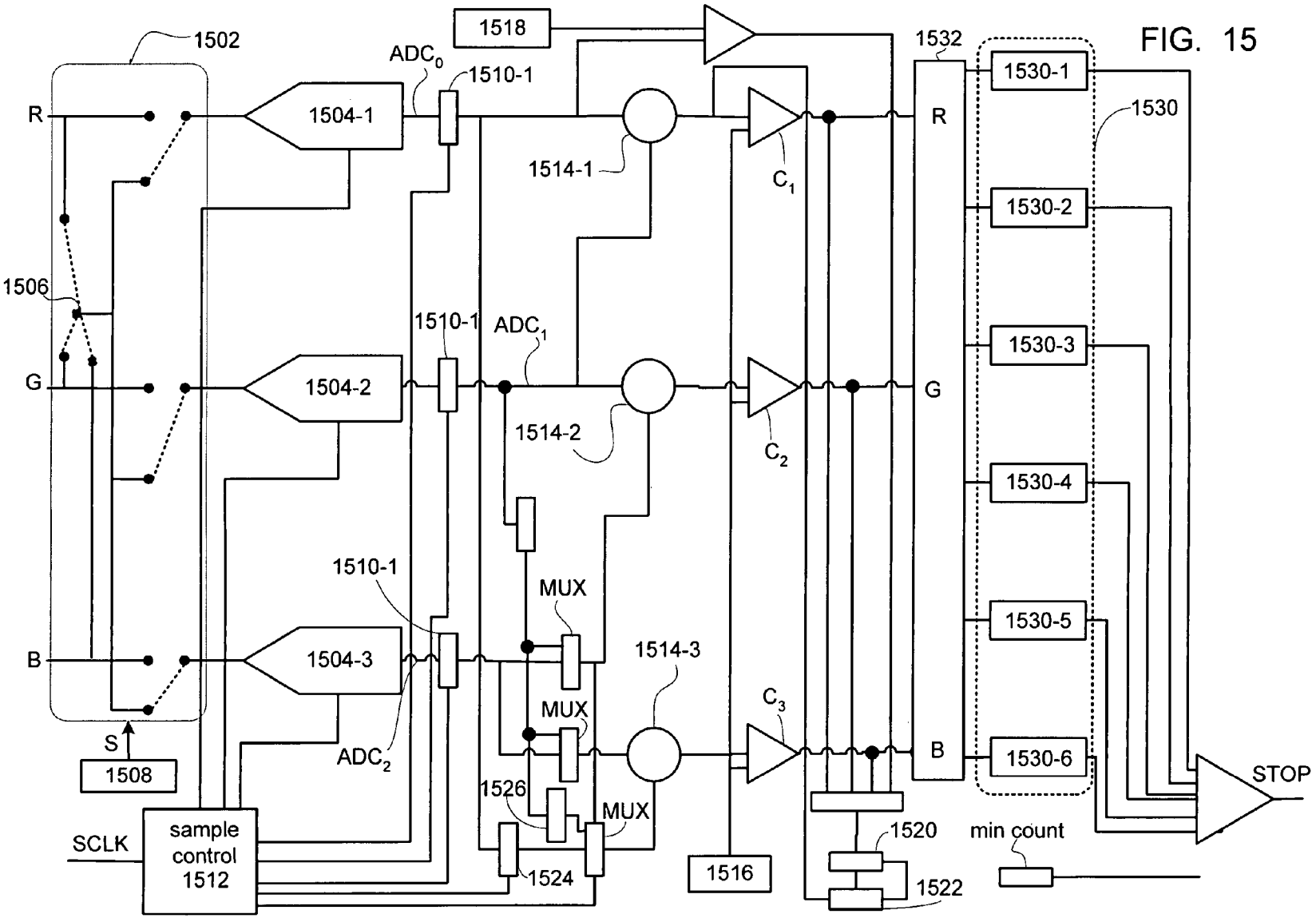
FIG. 15 illustrates an analog video signal synchronizer unit for automatically adjusting $H_{total}$ (clock) and phase for an incoming RGB signal in accordance with an embodiment of the invention.

FIG. 15 illustrates an analog video signal synchronizer unit 1500 for automatically adjusting $H_{total}$ (clock) and phase for an incoming RGB signal in accordance with an embodiment of the invention. It should be noted that the unit 1500 is but another implementation of the analog video synchronizer unit 100 shown in FIG. 1 and does not limit either the scope or intent of the invention. Accordingly, the synchronizer unit 1500 includes a number of analog switches 1502 coupled to analog to digital converter units (ADCs) 1504-1 through 1504-3 that in a normal mode permit each of the ADCs 1504 to monitor a particular video channel. For example, in the normal mode, the ADC 1504-1 monitors the R video channel whereas the ADC 1504-2 monitors the G video channel, and so on. In an optional mode, the analog switches 1502 can be set in such a way that each of the ADCs 1504 monitor the same channel, such as the R channel only. It should be noted that in this optional mode another analog switch 1506 is used to select which of the 3 channels is monitored. Therefore, in order to control the state of the analog switches 1502 and 1506, a control register 1508 provides an analog control signal S that corresponds to at least three switching modes shown in Table 1.

TABLE 1

| SWITCHING MODE | DESCRIPTION OF SWITCHING MODE |
|---|---|
| Normal | All ADCs convert at the same time |
| $H_{total}$ | The ADCs are each staggered in time by ⅓ of a pixel clock |
| Phase | Only 2 ADCs are used. Their conversion times are separated by approximately one phase step (around 300 pS) |

A number of data latches 1510-1 through 1510-3 each coupled to an output of the ADCs 1504-1 through 1504-3, respectively, latch the corresponding ADC output video data ($ADC_x$) based upon a sample control signal $S_{CTL}$ provided by a sample control unit 1512 based upon the system clock $S_{CLK}$. For example, the ADC 1504-1 outputs an ADC output video signal $ADC_0$ that is latched by the latch 1510-1. In the described embodiment, difference circuits 1514-1 through 1514-3 are coupled respectively to outputs of the latches 1510-1 through 1510-3. In the normal mode of operation, all video data processed by the ADCs 1504 is routed through a display data path (not shown) for displaying an image on the display 102. In the $H_{total}$ mode, however, the difference circuits 1514 compute the difference between the output of each of the ADCs 1504 with a selected ADC value being delayed by one pixel clock. Assuming, for example, that the selected ADC is ADC 1504-3 (where ADC 1504-1 through 1504-3 each have output signals, $ADC_0$, $ADC_1$, and $ADC_2$, respectively) then the output data from the difference circuits 1514 is as shown in Table 2.

TABLE 2

| ADC | Output Signal | Difference Ckt | Difference Circuit Output |
|---|---|---|---|
| 1504-1 | $ADC_0$ | 1514-1 | $ADC_1 - ADC_0$ |
| 1504-2 | $ADC_1$ | 1514-2 | $ADC_2 - ADC_1$ |
| 1504-3 | $ADC_2$ | 1514-3 | $ADC_0 - ADC_2$ Delayed |

Therefore, by taking the output data from the difference circuits in the correct order, the sequence of difference circuit output values represents the differences between each of the oversampled pixels so as to simulate a single ADC running at 3× normal speed.

In the described embodiment, the difference circuits 1514 can be configured to operate in 4 different modes described in Table 3.

TABLE 3

| DIFFERENCE CIRCUIT OPERATIONS MODE | |
|---|---|
| MODE | DESCRIPTION |
| Absolute | The absolute difference between the inputs. The result is positive regardless of which input is the largest |
| Positive | A value will be output only if the difference between the inputs is positive. If the difference is negative, zero will be output. |
| Negative | A value will be output only if the difference between the inputs is negative. The output will be made positive. If the difference is positive, zero will be output. |

In the described implementation, in the $H_{total}$ mode, the synthesizer 1500 uses the positive difference. In $H_{total}$ mode, the difference circuits 1514 output 3 values:

$ADC_2$-$ADC_1$ $ADC_1$-$ADC_0$ $ADC_0$-$ADC_2$ Delayed

Subsequently, each of these values is compared to the content of a difference register 1516 by comparators $C_1$, $C_2$, and $C_3$, respectively. If these output values are above a threshold value stored in a minimum level register 1518, then an edge flag is set to a value of one ("1") in at least one of a number of associated output registers 1520 indicating the presence of an edge at that location, otherwise the flag remains at a default value (i.e., "0"). The edge flag value(s) are passed on to an accumulator 1522 that takes all the data from the difference circuits and accumulates it.

In the phase mode, a selected difference circuit (1514-1, for example) outputs a single value that is passed through a register, clocked by the pixel clock $S_{CLK}$, so as to delay it by one pixel clock:

$ADC_1$-$ADC_0$ Delayed

In addition, the ADC value $ADC_0$ is passed through registers 1524 and 1526 providing in the process the following values:

$ADC_0$ $ADC_0$ Delayed $ADC_0$ Delayed twice.

These three output values are then used to determine whether or not the associated pixel is adjacent to an edge since only pixels that are adjacent to an edge are qualified to be used to measure the flatness of the video signal. It should be noted that if a pixel is in the middle of a sequence of pixels each of a similar value, the synchronizer unit 1500 will give a very flat result which is not related to its flatness if disturbed by an adjacent edge.

The difference circuits 1514 then compute the difference values shown in Table 5.

TABLE 5

| | |
|---|---|
| $ADC_0$ Delayed − $ADC_0$ | After difference (indicates the presents of an edge after this pixel) |
| $ADC_0$ Delayed twice − $ADC_0$ Delayed | Before difference (indicates the presents of an edge before this pixel) |

In the described embodiment, the before and after difference values are then compared to threshold values stored in threshold registers 1518. If the values are above the corresponding threshold value, then an edge flag is set to one indicating the presence of an edge, otherwise, the edge flag remains at a default zero value. These two edge flags are passed on to the accumulator 1522, as well as being used to gate the flatness value ($ADC_1$-$ADC_0$ Delayed) to the accumulator 1522. It should also be noted that the video level ($ADC_0$ Delayed) is compared to a level threshold and only if the value is above the threshold are the edge flags and flatness values passed to the accumulator 1522. This feature insures that only flatness values from pixels that are not black are used (since such pixels would typically appear to be very flat).

In a particular embodiment, the synchronizer unit 1500 utilizes a programmable window detector to select the area of the image to be used for auto adjustment. Typically the window will be set to include all of the active area.

In the described embodiment, there are a number of edge count accumulators 1530. Based upon edge logic 1532, the edge accumulators 1530 accumulate edge flag value data. In the case of six edge accumulators, three accumulate edges that occur only on one of the three channels whereas the other 3 accumulators accumulate edges that occur only on two neighboring edges. In this way the edges are accumulated according to their phase position within the pixel, with a precision of almost $1/6^{th}$. In $H_{total}$ mode a large value in only one or two adjacent ones of these accumulators indicates that the current $H_{total}$ is correct therefore each $H_{total}$ must be tested in turn until the correct one is found. In phase mode, three of these accumulators count the number of before, after, and both edges. In phase mode there is also an accumulator that accumulates the qualified flatness values. So the flatness of a particular phase is given by the accumulated flatness divided by the sum of the three edge counters.

In the described embodiment, data capture is started by setting a RUN/~STOP bit to 1 while synchronization occurs on the next $V_{sync}$ signal. Once the current position is within the active window, collection of data begins. In $H_{total}$ mode data capture is stopped if any of the edge count accumulators 1530 equal the value in a min_count register. In phase mode data capture is stopped if selected ones of the edge count accumulators 1530 (1530-4 through 1530-6, for example) equal the value in the minimum count register, or if a value stored in a flat accumulator register reaches a maximum value. If at the end of the scan line none of these conditions are met, then the edge count accumulators and flat accumulator registers are set to 0 and data collection begins again on the next scan line. At the end of the active window, data capture is stopped. When data capture is stopped the RUN/~STOP bit is cleared to 0. In this way, the synchronization is performed on a scan line by scan line basis.

It is contemplated that in those systems that include a microcontroller, the microcontroller is able to read and write the control registers as well as read the accumulation register. In the current implementation, the various registers are as shown in FIG. 16.

$H_{total}$ Mode

Figure 17:
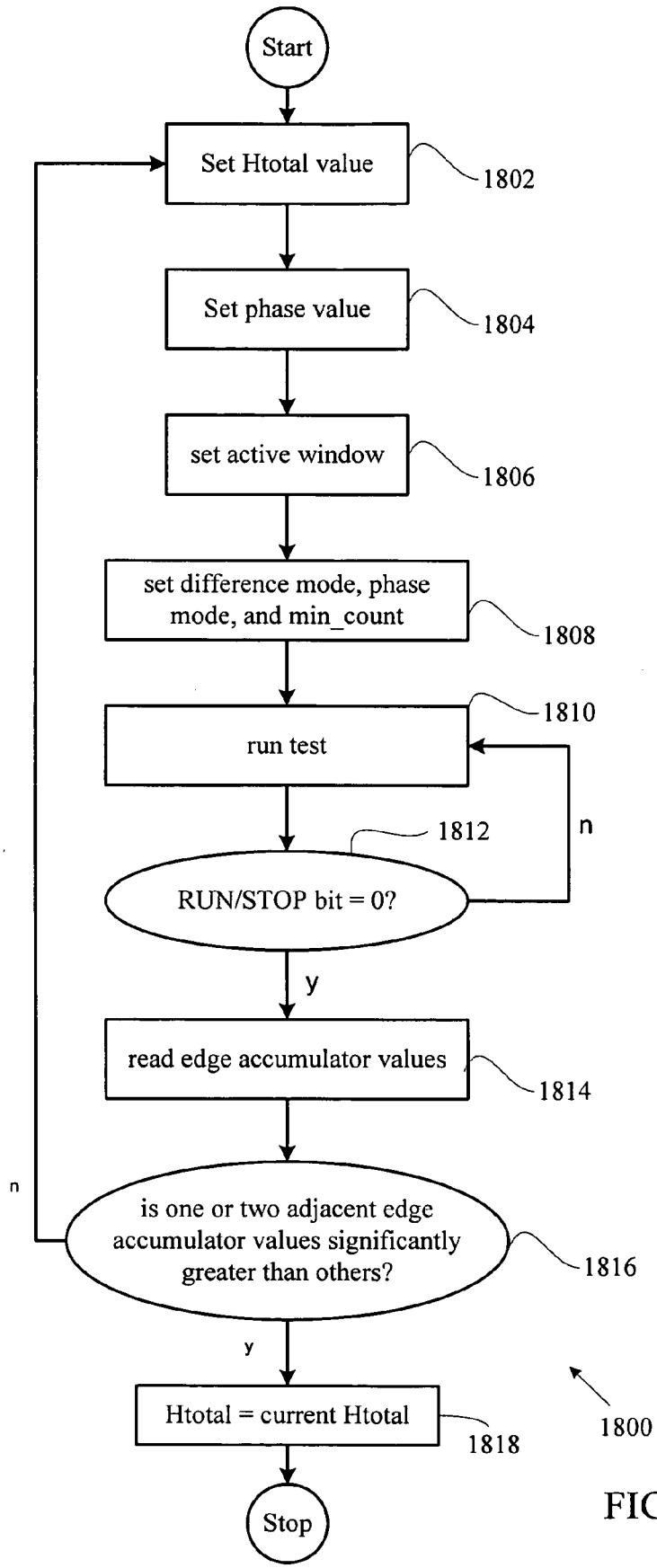
FIG. 17 shows a flow chart detailing a process for providing $H_{total}$ in accordance with an embodiment of the invention.

FIG. 17 shows a flow chart detailing a process 1800 for providing $H_{total}$ in accordance with an embodiment of the invention. At 1802, the $H_{total}$ is set to an initial value to start the test. Typically this is the value obtained from a standard VESA mode. Next, at 1804, the phase is set to a known value (typically zero) while at 1806, the active window and thresholds are set. At 1808, the difference controls are set (to Positive, for example), while PHASE_MODE is set to 0, and MIN_COUNT to a pre-selected value. At 1810, the measurement is started while querying the RUN/STOP bit at 1812 for a zero value at which point the edge accumulators are read at 1814. If it is determined that one or two adjacent ones of the edge accumulators have a significantly higher value than the other edge accumulators at 1816, then the current $H_{total}$ is essentially correct. Otherwise a different $H_{total}$ is used at 1818 (based upon a spiral algorithm, for example) and the measurement is repeated using the new $H_{total}$.

Phase Mode

Figure 18:
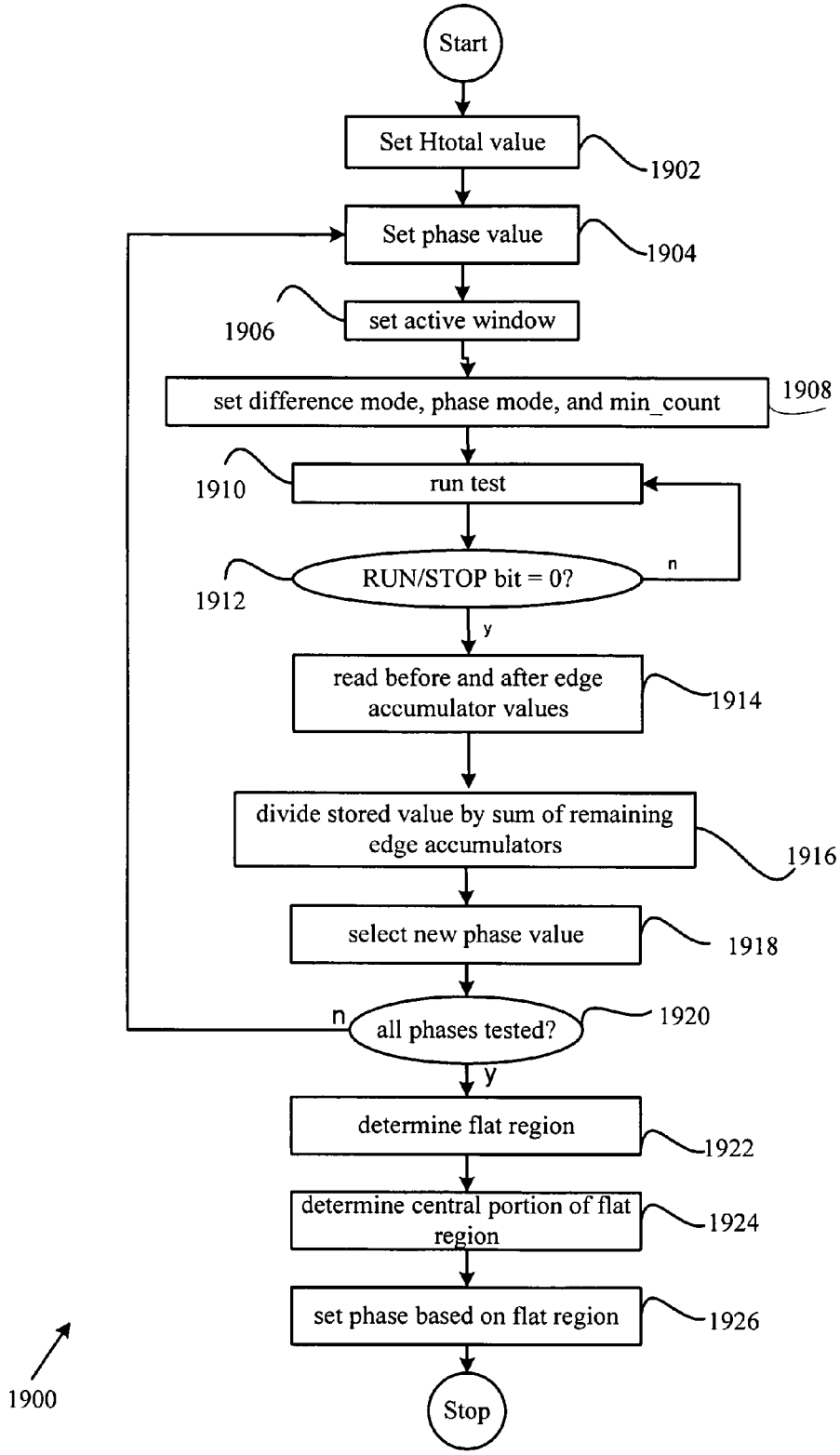
FIG. 18 shows a flow chart detailing a process for providing phase in accordance with an embodiment of the invention.

FIG. 18 shows a flow chart detailing a process 1900 for providing phase in accordance with an embodiment of the invention. Accordingly, the process 1900 begins at 1902 by setting the test $H_{total}$ to the correct $H_{total}$. At 1904, the phase is set to zero while at 1906 the active window and thresholds are set. At 1908, the difference controls are set to Absolute), PHASE_MODE to 1, MIN_COUNT to a pre-determined value while at 1910 the measurement is started until such time as the RUN/STOP bit is determined to be zero at 1912. When it is determined that the RUN/STOP bit is equal to zero, the 3 edge accumulators that count the before edges, the after edges, and both edges are queried at 1914 and the value stored in the FLATNESS_ACCUM is divided by the sum of the 3 edge counters providing a flatness value for the current phase at 1916. At 1918, a different phase value is selected and control is passed back to 1904 until a pre-set number of phase values have been accumulated at 1920. Once the number of phase values and associated flatness values are accumulated, a flat region is determined at 1922 and a middle region of the flat region is identified at 1924 as the correct phase is set at 1926.

Figure 19:
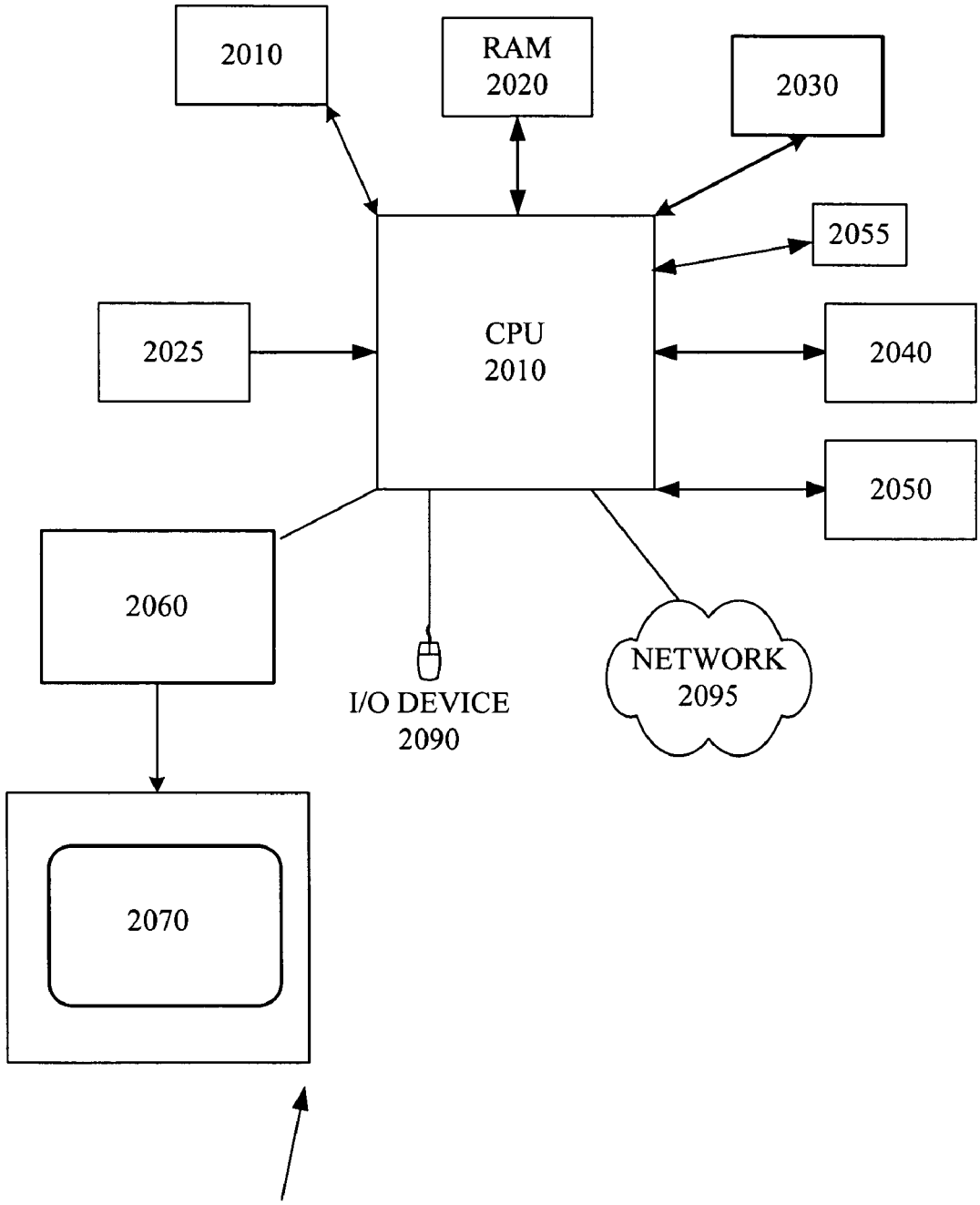
FIG. 19 illustrates a computer system employed to implement the invention.

FIG. 19 illustrates a computer system 2000 employed to implement the invention. Computer system 2000 is only an example of a graphics system in which the present invention can be implemented. Computer system 2000 includes central processing unit (CPU) 2010, random access memory (RAM) 2020, read only memory (ROM) 2025, one or more peripherals 2030, graphics controller 2060, primary storage devices 2040 and 2050, and digital display unit 2070. As is well known in the art, ROM acts to transfer data and instructions uni-directionally to the CPUs 2010, while RAM is used typically to transfer data and instructions in a bi-directional manner. CPUs 2010 may generally include any number of processors. Both primary storage devices 2040 and 2050 may include any suitable computer-readable media. A secondary storage medium 2055, which is typically a mass memory device, is also coupled bi-directionally to CPUs 2010 and provides additional data storage capacity. The mass memory device 2055 is a computer-readable medium that may be used to store programs including computer code, data, and the like. Typically, mass memory device 880 is a storage medium such as a hard disk or a tape which generally slower than primary storage devices 2040, 2050. Mass memory storage device 2055 may take the form of a magnetic or paper tape reader or some other well-known device. It will be appreciated that the information retained within the mass memory device 2055, may, in appropriate cases, be incorporated in standard fashion as part of RAM 2020 as virtual memory.

CPUs 2010 are also coupled to one or more input/output devices 1490 that may include, but are not limited to, devices such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, CPUs 2010 optionally may be coupled to a computer or telecommunications network, e.g., an Internet network or an intranet network, using a network connection as shown generally at 1495. With such a network connection, it is contemplated that the CPUs 2010 might receive information from the network, or might output information to the network in the course of performing the above-described method steps. Such information, which is often represented as a sequence of instructions to be executed using CPUs 2010, may be received from and outputted to the network, for example, in the form of a computer data signal embodied in a carrier wave. The above-described devices and materials will be familiar to those of skill in the computer hardware and software arts.

Graphics controller 2060 generates analog image data and a corresponding reference signal, and provides both to digital display unit 2070. The analog image data can be generated, for example, based on pixel data received from CPU 2010 or from an external encode (not shown). In one embodiment, the analog image data is provided in RGB format and the reference signal includes the VSYNC and HSYNC signals well known in the art. However, it should be understood that the present invention can be implemented with analog image, data and/or reference signals in other formats. For example, analog image data can include video signal data also with a corresponding time reference signal.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

While this invention has been described in terms of a preferred embodiment, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

What is claimed is:

1. A selectable analog video signal synthesizer unit coupled to an analog video source and arranged to provide an analog video signal operable in a number of operating modes that includes a normal mode, an $H_{total}$ mode, and a phase mode, comprising:

a selectable set of analog switches operable in a number of switching modes coupled to the video source;

a number of analog/digital converter units (ADC) each of which is connected to a corresponding one of the set of analog switches;

a difference circuit arranged to receive an output signal from at least one of the ADCs and provide a differenced output signal based upon the operating mode; and an output unit coupled to the difference circuit arranged to provide an $H_{total}$ value in the $H_{total}$ mode based on the detection of edges of image features in a video frame from the video source and a phase value in the phase mode for the analog video signal.

2. An analog video signal synthesizer unit as recited in claim 1 wherein the video synthesizer unit is coupled to a digital display.

3. An analog video signal synthesizer unit as recited in claim 2, wherein the digital display is an LCD capable of receiving and displaying an analog video signal formed of a number of individual video frames from an analog video source.

4. An analog video signal synthesizer unit as recited in claim 3 wherein each video frame includes video information displayed as the displayed features taken together form a displayed image on the display LCD.

5. An analog video signal synthesizer unit as recited in claim 4, wherein the analog video signal synthesizer unit is a pre-processor.

6. An analog video signal synthesizer unit as recited in claim 4, wherein the analog video signal synthesizer unit is an integrated circuit.

7. An analog video signal synthesizer unit as recited in claim 6, wherein, the video signal synchronizer unit is included in an input system suitably arranged for pre-processing video signals derived from the analog video source.

8. An analog video signal synthesizer unit as recited in claim 4, wherein the analog video source is an analog video camera.

9. An analog video signal synthesizer as recited in claim 4, wherein analog video signal synthesizer is active during a display monitor initialization procedure.

10. An analog video signal synthesizer as recited in claim 4, wherein analog video signal synthesizer is active when a display resolution has been changed from a first resolution to a second resolution, and vice versa.

11. An analog video signal synthesizer as recited in claim 10, wherein the first resolution is VGA and the second resolution is XGA.

12. An analog video signal synthesizer as recited in claim 11 wherein the analog video signal synthesizer is activated either manually or automatically.

13. An analog video signal synthesizer as recited in claim 1, wherein when the analog video signal synthesizer unit is operating in the $H_{total}$ mode, the difference circuit is arranged to provide a differenced output signal for each combination of two ADCs based on the difference in the output signals from the two corresponding ADCs of the particular combination.

14. An analog video signal synthesizer as recited in claim 13, further comprising a difference register and a number of comparators, each comparator being coupled to the difference register and a differenced output signal for a particular combination of ADCs, each comparator being arranged to compare the associated difference output signal with a value in the difference register.

15. An analog video signal synthesizer as recited in claim 14, further comprising a number of output registers, wherein when the output of a one of the comparators is above a threshold, an edge flag in at least one of the output registers is set to a value of 1 from a default value of 0 to indicate the presence of an edge.

16. An analog video signal synthesizer as recited in claim 15, further comprising a number of edge accumulators that accumulate edge flag data.

17. An analog video signal synthesizer as recited in claim 16, further comprising a calculator unit that calculates the $H_{total}$ value based upon a pattern of the edge flag data.

18. An analog video signal synthesizer as recited in claim 1, wherein the video source is comprised of Red, Green and Blue components and wherein each analog switch receives a different one of the Red, Green or Blue components.

19. An analog video signal synthesizer as recited in claim 18, wherein each ADC coupled to a one of the analog switches is staggered in time by one-third of a pixel clock.

20. An analog video signal synthesizer as recited in claim 1, wherein the phase value is based on a pixel clock associated with a central portion of a flat region detected for the analog video signal.

21. An analog video signal synthesizer as recited in claim 20, wherein when the analog video signal synthesizer unit is operating in the phase mode, the difference circuit is arranged to generate a differenced output signal for only two of the ADCs.

22. An analog video signal synthesizer as recited in claim 21, wherein each ADC coupled to a one of the analog switches is separated in time by one phase step.

* * * * *